US008336635B2

(12) United States Patent
Greenlee et al.

(10) Patent No.: US 8,336,635 B2
(45) Date of Patent: Dec. 25, 2012

(54) DOWNHOLE APPARATUS WITH PACKER CUP AND SLIP

(76) Inventors: Donald Roy Greenlee, Murchison, TX (US); Donald Jonathan Greenlee, Murchison, TX (US)

( * ) Notice: Subject to any disclaimer, the term of this patent is extended or adjusted under 35 U.S.C. 154(b) by 0 days.

(21) Appl. No.: 13/323,934

(22) Filed: Dec. 13, 2011

(65) Prior Publication Data

US 2012/0080202 A1 Apr. 5, 2012

Related U.S. Application Data

(63) Continuation of application No. 12/258,613, filed on Oct. 27, 2008, now Pat. No. 8,113,276.

(51) Int. Cl.
*E21B 33/12* (2006.01)

(52) U.S. Cl. ..... 166/387; 166/202; 166/216

(58) Field of Classification Search ..... 166/387, 166/202, 216

See application file for complete search history.

(56) References Cited

U.S. PATENT DOCUMENTS

| | | | |
|---|---|---|---|
| 2,578,900 | A | 9/1946 | Ragan |
| 2,630,866 | A | 9/1946 | Ragan |
| 2,711,795 | A | 10/1949 | Ragan |
| 2,802,532 | A | 9/1955 | Burtner |
| 3,062,291 | A | 11/1962 | Brown |
| 3,074,484 | A | 1/1963 | Conrad |
| 3,120,272 | A | 2/1964 | Cochran |
| 3,358,766 | A | 12/1967 | Current |
| 3,412,803 | A | 11/1968 | Stachowiak |
| 3,437,137 | A | 4/1969 | Scott |
| 3,548,936 | A | 12/1970 | Kilgore |
| 3,587,736 | A | 6/1971 | Brown |
| 3,910,348 | A | 10/1975 | Pitts |
| 4,076,077 | A | 2/1978 | Nix et al. |
| 4,212,352 | A | 7/1980 | Upton |
| 4,216,827 | A | 8/1980 | Crowe |
| 4,583,590 | A | 4/1986 | Greenlee |
| 4,844,154 | A | 7/1989 | Ross |
| 5,086,839 | A | 2/1992 | Setterberg |
| 5,215,148 | A | 6/1993 | Ricles |
| 5,224,540 | A | 7/1993 | Streich et al. |
| 5,501,281 | A | 3/1996 | White et al. |
| 5,984,007 | A | 11/1999 | Yuan et al. |
| 6,394,180 | B1 | 5/2002 | Berscheidt et al. |
| 6,581,681 | B1 | 6/2003 | Zimmerman et al. |

(Continued)

OTHER PUBLICATIONS http://www.halliburton.com/ps/PrintPreview.aspx?navid=87 &pageid=380&prodid=PRN%3a%3aIVQ1FLCZF, Fas Drill Frac Plug, printed Jun. 23, 2008.

(Continued)

*Primary Examiner* — Nicole Coy

(74) *Attorney, Agent, or Firm* — James E. Walton; J. Oliver Williams

(57) ABSTRACT

A downhole apparatus and for use in a well bore and associated method are disclosed. The downhole apparatus includes a center mandrel. A slip means is disposed on the mandrel. The slip means can include teeth or the like for grippingly engaging the well bore when in a set position. A retractable packer cup is also disposed on the mandrel. The retractable packer cup is provided for sealing an annulus between the mandrel and the well bore. The retractable packer cup is slidable relative to the mandrel, and can be controlled to slide along the mandrel in order to move the slip to the set position. Also disclosed is a downhole assembly that includes a downhole tool and a setting apparatus. The setting apparatus can be used for lowering the downhole apparatus to a desired setting depth and then releasing the downhole apparatus.

18 Claims, 20 Drawing Sheets

U.S. PATENT DOCUMENTS

| | | | |
|---|---|---|---|
| 6,708,768 | B2 | 3/2004 | Slup et al. |
| 6,708,770 | B2 | 3/2004 | Slup et al. |
| 6,827,150 | B2 | 12/2004 | Luke |
| 6,926,086 | B2 | 8/2005 | Patterson et al. |
| 6,976,534 | B2 | 12/2005 | Sutton et al. |
| 7,261,153 | B2 | 8/2007 | Plomp |
| 5,224,540 | C1 | 11/2007 | Streich et al. |
| 7,350,582 | B2 | 4/2008 | McKeachnie et al. |
| 7,373,973 | B2 | 5/2008 | Smith et al. |

OTHER PUBLICATIONS http://www.halliburton.com/ps/PrintPreview.aspx?navid=87&pageid=379&prodid=PRN%3a%3aIVQ12SLPT, Fas Drill Bridge Plug, printed Jun. 23, 2008.

Office Action dated Feb. 4 , 2011 from parent U.S. Appl. No. 12/258,613.

Amendment dated May 4 , 2011 in response to the Office Action dated Feb. 4, 2011 from parent U.S. Appl. No. 12/258,613.

DOWNHOLE APPARATUS WITH PACKER CUP AND SLIP

CROSS REFERENCE TO RELATED APPLICATIONS

This application is a continuation of U.S. application Ser. No. 12/258,613, filed 27 Oct. 2008, titled "Downhole Apparatus with Packer Cup and Slip," which is hereby incorporated by reference for all purposes as if fully set forth herein.

BACKGROUND

1. Field of the Invention

The present application relates to downhole tools for use in well bores, as well as methods of using such downhole tools. In particular, the present application relates to downhole tools and methods for plugging a well bore.

2. Description of Related Art

Prior downhole tools are known, such as frac plugs and bridge plugs. Such downhole tools are commonly used for sealing a well bore. These types of downhole tools typically can be lowered into a well bore in an unset position until the downhole tool reaches a desired setting depth. Upon reaching the desired setting depth, the downhole tool is set. Once the downhole tool is set, the downhole tool acts as a plug preventing fluid from traveling from above the downhole tool to below the downhole tool.

While such downhole tools have proven useful, they still have several shortcomings. For example, setting prior downhole tools typically involves a process that include sending electrical charges down the well to the well bore for electrically activating a setting mechanism. Such setting processes can include firing explosive charges in the well bore for setting the downhole tool. Such setting processes add undesirable complexity and risk to downhole operations. For example, since the setting process is often followed by transmitting an electrical signal down the well for firing a perforating gun, there is a risk that the electrical setting signal could prematurely fire the perforating gun.

Another problem with prior downhole tools involves removal of the tool. It is often necessary to remove the downhole tool once the plug provided by the downhole tool is no longer needed or desired. One common method of removing the plug is to drill through the plug. However, prior downhole tools were typically made of very hard metals, such as steel, are very difficult to drill through, adding significant difficulty to the removal process.

Although the foregoing designs represent considerable advancements in the area of downhole tools, many shortcomings remain.

DESCRIPTION OF THE DRAWINGS

The novel features believed characteristic of the invention are set forth in the appended claims. However, the invention itself, as well as a preferred mode of use, and further objectives and advantages thereof, will best be understood by reference to the following detailed description when read in conjunction with the accompanying drawings, wherein:

DETAILED DESCRIPTION OF THE PREFERRED EMBODIMENT

Figure 1:
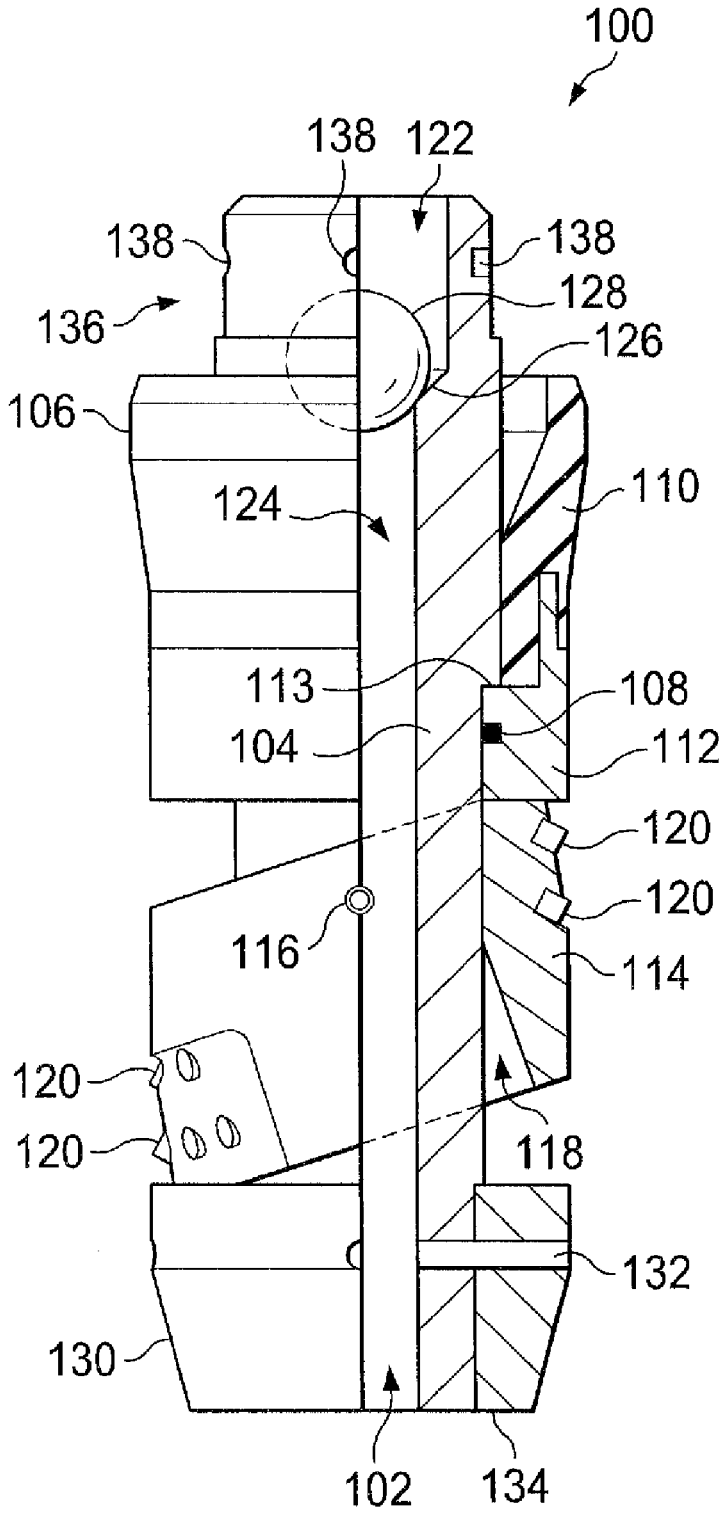
FIG. 1 shows a partly sectional view of an embodiment of a downhole tool in an unset position.

Referring to FIG. 1 in the drawings, a downhole tool or frac plug is shown and designated by the numeral 100. The downhole tool 100 is suitable for use in oil and gas well service applications. Downhole tool 100 defines a central opening 102 therein. Downhole tool 100 comprises a center mandrel 104. The central opening 102 extends longitudinally through the center mandrel 104.

A packer cup 106 is disposed around an upper portion of mandrel 104 and generally encloses an o-ring 108. The o-ring 108 extends around the mandrel 104 and can be made of any material suitable for serving as a seal to prevent the flow of fluid between the mandrel 104 and the packer cup 106.

The packer cup 106 includes an elastomer lip portion 110 and a packer cup base 112. The packer cup 106 is a sliding packer cup 106, meaning that the packer cup 106 can slide along at least a portion of the length of the mandrel 104. A shoulder 113 formed in the mandrel 104 prevents the packer cup 106 from sliding any further up the mandrel 104 from the position shown in FIG. 1. Thus, the shoulder 113 serves as a packer-cup retainer, in that the shoulder 113 helps retain the packer cup 106 onto the mandrel 104. The packer cup 106 can slide further down the mandrel 104 from the position shown in FIG. 1 to the position shown in FIG. 3 as explained below in connection with FIG. 3.

Disposed below packer cup 106 is a slip 114, which serves as an example of a slip means. The slip 114 is initially held in place by a retaining means, such as shear pin 116 or the like. The slip 114 has a generally cylindrical body with a dual-axis bore passage 118 longitudinally therethrough. In some embodiments, the slip 114 can be a slip as described in U.S. Pat. No. 4,212,352 to Upton, titled "Gripping Member for Well Tools," which is hereby incorporated by reference. The slip 114 has an outer gripping surface formed by a plurality of teeth elements 120 arranged in groupings to provide constant and positive gripability of the slip 114 in a well casing. The teeth elements 120 are arranged in groupings such that outer or crest edge surfaces thereof outline a curved profile which uniformly engages the well casing upon rotation of the slip for setting the downhole tool 100 as described below.

The central opening 102 has at least two different diameters. The central opening 102 has an upper opening portion 122 and a smaller lower opening portion 124. The upper opening portion 122 and lower opening portion 124 are separated by an upwardly-facing chamfered shoulder 126, which serves as a ball seat. A ball 128 is disposed in the upper opening portion 122 and is adapted for engagement with shoulder 126. The outside diameter of the ball 128 is smaller than the inner diameter of the upper opening portion 122, but larger than the inner diameter of the lower opening portion 124.

A guide or mule shoe 130 is secured to mandrel 104 below the slip 114. The guide 130 can be secured to the mandrel 104 by any suitable attachment means. For example, the guide 130 can be secured to the mandrel 104 by radially oriented pins 132. The guide 130 has a lower end 134, which serves as the lower end of the downhole tool 100. The lower most portion of the downhole tool 100 need not be a mule shoe or guide 130, but could be any type of section that serves to terminate the structure of the downhole tool 100 or serves as a connector for connecting downhole tool 100 with other tools, a valve, tubing, or other downhole equipment.

Figure 2:
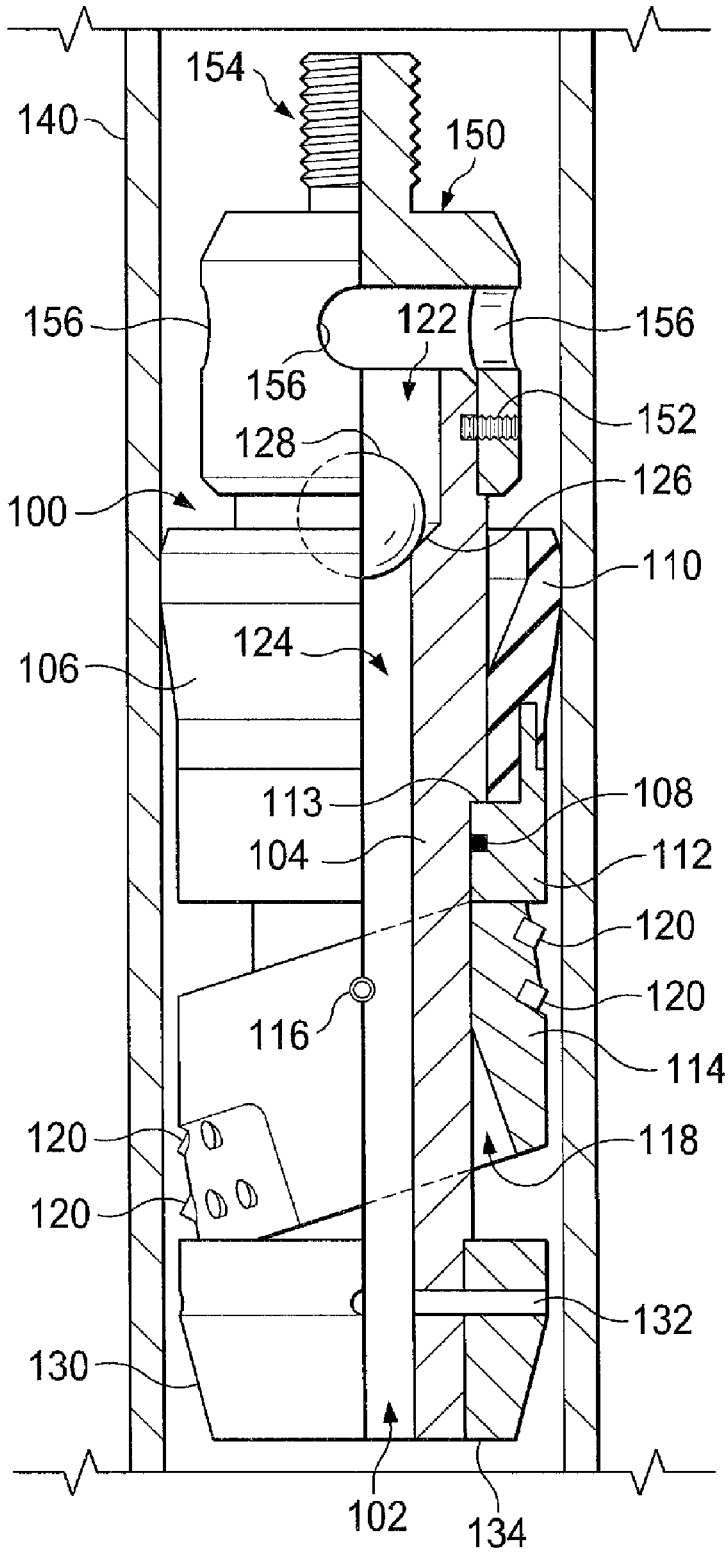
FIG. 2 shows the downhole tool of FIG. 1 attached to a setting adaptor.

Reference will now also be made to FIG. 2, where the downhole tool 100 is shown disposed in a well casing 140. The upper end of the mandrel 104 is formed as a connecting portion 136 for mating and connecting to other tools, a valve, adapters, tubing, or other downhole equipment. The connecting portion 136 includes one or more attachment holes 138 configured to receive attachment hardware, for example bolts or pins, for securing other tools, adapters, equipment, or the like to the mandrel 104.

For example, as shown in FIG. 2, the connecting portion 136 can be attached to an adapter 150. The adapter 150 serves as an example of a setting apparatus, more specifically a shearable setting adapter, which can be used for installing the downhole tool 100 in a well casing 140 or borehole wall. The adapter 150 is configured to be attached to the downhole tool 100 by securing the adapter 150 to the connecting portion 136 of the mandrel 104. As shown in FIG. 2, one or more shearable pins 152 can be used to attach the adapter 150 to the connecting portion 136 of the mandrel 104. The adapter 150 also includes an upper connecting portion 154, which can included a threaded region as shown in FIG. 2. In alternative embodiments, the connecting portion 154 can be configured for other types of attachment. The connecting portion 154 is configured to be connected to a sand line, wire line, or other cable means that can be lowered into a well bore.

The upper portion of the adapter 150, including the connecting portion 154, is solid. The lower portion of the adapter 150 defines a chamber 155 that is in fluid communication with the central opening 102 of the downhole tool 100 when the adapter 150 is attached to the downhole tool 100. The adapter 150 also includes one or more bores 156. The bores 156 provide for fluid communication between the chamber 155 and the outside of the adapter 150. Thus, when the adapter 150 is attached to the downhole tool 100, the bores 156 allow for fluid communication between the outside of the adapter 150 and the central opening 102.

Figure 3:
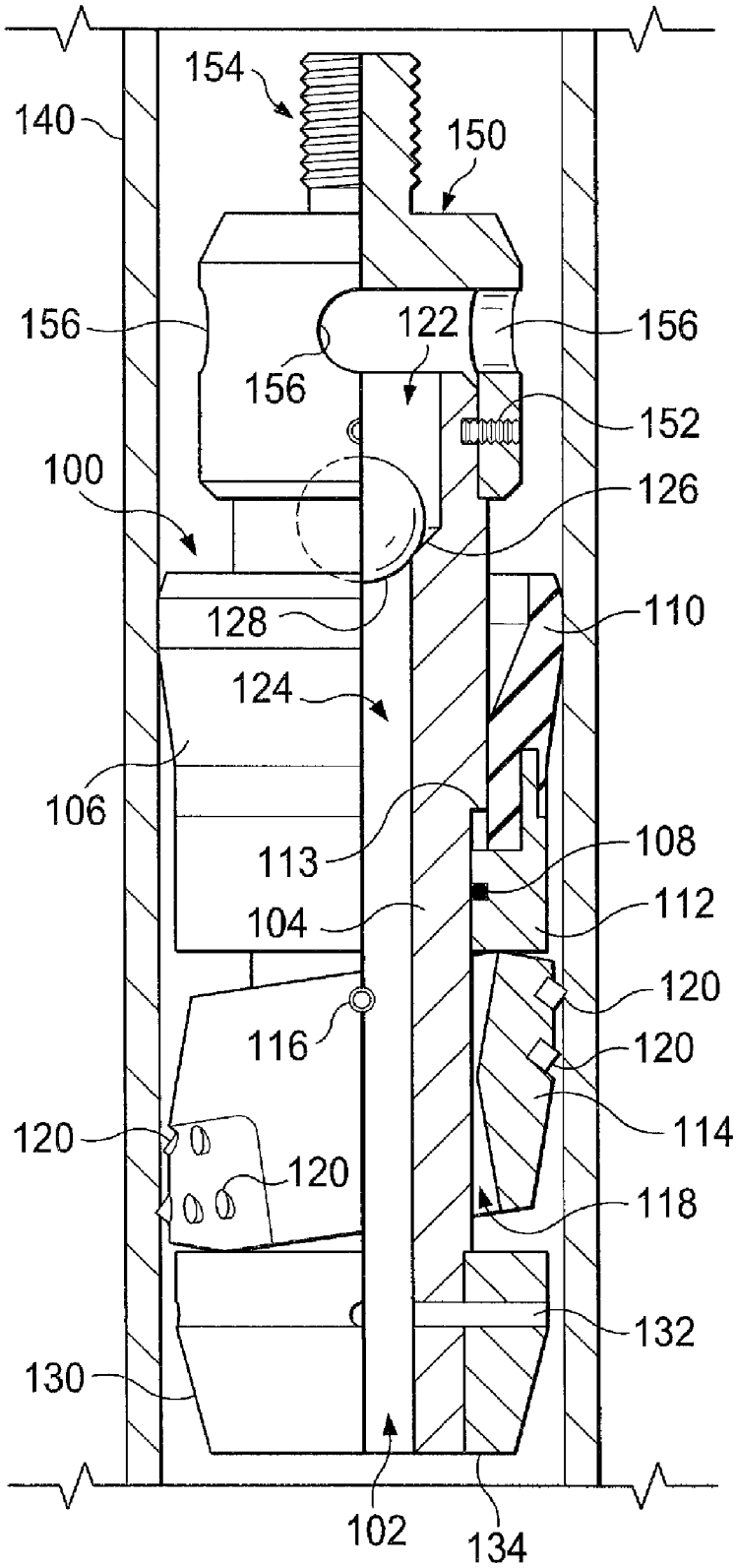
FIG. 3 shows the downhole tool of FIG. 1 in a set position.

Referring now also to FIG. 3, installation of the downhole tool 100 will now be described. FIGS. 1 and 2 show the downhole tool 100 in what will be referred to herein as an "unset" position. When the downhole tool 100 is in an unset position, the downhole tool 100 can be raised and lowered in a well bore or well casing. FIG. 3 shows the downhole tool 100 in what will be referred to herein as a "set" position. When the downhole tool 100 is in a set position, the downhole tool 100 is considered to be installed, or fixed in place relative to the well bore or well casing.

The installation of the downhole tool 100 in a well bore or well casing is made by attaching a shearable setting adapter such as adapter 150 to the connecting portion 136 of the downhole tool 100 using one or more shear pins 152. A connecting line (not shown), such as a sand line, wire line, or other cable means, is attached to the connecting portion 154 of the setting adapter 150. Examples of alternative cable means include coil tubing, steel tubing, fiberglass tubing, or other types of cables or tubing that can be lowered into a well bore or well casing. The downhole tool 100 is then lowered into a well bore, which may or may not include a well casing 140. As the downhole tool 100 travels down into the well bore, fluids in the well bore will pass through the central opening 102 of the mandrel 104 and past the ball 128. When the desired setting depth is reached, the downhole tool 100 is set by creating a differential pressure across the packer cup 106, o-ring 108, and ball 128. The differential pressure can be applied by either pulling up on the connecting line attached to the setting adapter 150 or pumping fluid into the well bore above the downhole tool 100. Fluid weight or pump pressure will seat the ball 128 on the shoulder 126 of the mandrel 104. Fluid weight or pump pressure will also bear downwardly against the packer cup 106 and o-ring 108. The elastomer lip portion 110 of the packer cup 106 provides a pressure seal to the inside surface of the well casing 140 or well bore wall. When this downward pressure is applied to the packer cup 106, the packer cup 106 moves downwardly, bearing against the slip 114 causing the shear pin 116 to shear. The shearing of the shear pin 116 allows the slip 114 to rotate from the position shown in FIGS. 1 and 2 to the position shown in FIG. 3, and also allows the packer cup 106 to move downwardly from the position shown in FIGS. 1 and 2 to the position shown in FIG. 3. As the slip 114 rotates, the teeth 120 at least partially penetrate the inner surface of the well casing 140 or well bore wall.

The shear pin 116 is selected to have a shear value that is lower than the shear value of the shearable pin 152 used to connect the adapter 150 to the mandrel 104. After the slip 114 rotates to the set position shown in FIG. 3, the adapter 150 is pulled upwardly using the connecting line to shear the shearable pin 152, thereby separating the adapter 150 from the downhole tool 100. The downhole tool 100 is then in a set position as shown in FIG. 3 and the adapter 150 can be removed from the well. The downhole tool 100 can now hold fracturing pressure from above the downhole tool 100. The ball 128 will seat onto the shoulder 126 in the presence of downward pressure, thereby blocking the central opening 102 of the mandrel 104. Also, the elastomer lip portion 110 of the packer cup 106 will bear against the well casing 140 or well bore wall in the presence of downward pressure, thereby blocking the region between the mandrel 104 and the inner surface of the well casing 140 or well bore wall.

Figure 4:
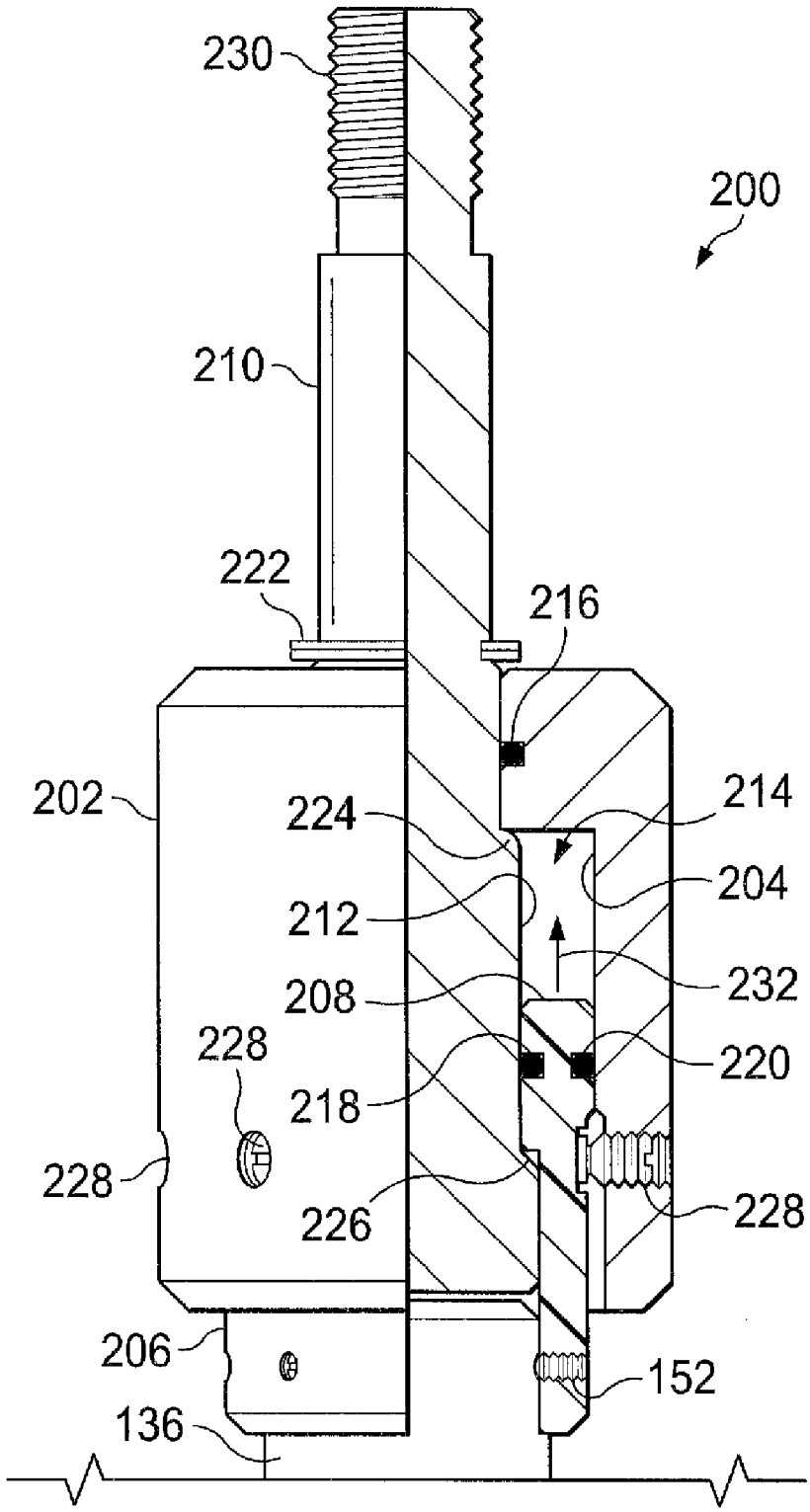
FIG. 4 shows a partly sectional view of an alternative setting adapter that serves as a hydrostatic release tool.

Turning next to FIG. 4, an alternative setting adapter is shown as hydrostatic release tool 200, which serves as an example of a setting apparatus. The release tool 200 can be used as an alternative to the adapter 150 in the description above. The release tool 200 is shown in a fully extended position. Release tool 200 has an outer housing 202 with an inner housing wall 204. Release tool 200 also has a tubular adapter mandrel 206 with an upper mandrel wall 208. Release tool 200 further has a solid central pin 210 with an outer wall 212. An annular chamber 214 is defined by at least a portion of each of the inner housing wall 204, the upper mandrel wall 208, and the outer wall 212 of the central pin 210.

The chamber 214 is sealed to prevent fluid communication therewith and filled with air or other compressible fluid at a predetermined chamber pressure. In some embodiments, for example, the chamber 214 can be an atmospheric chamber where the chamber pressure is at or near atmospheric pressure, for example atmospheric pressure at sea level, which is about 100 kPa or 14.7 psi. The chamber 214 can be sealed by a plurality of gaskets or o-rings. For example, in the embodiment shown in FIG. 4, the chamber 214 is sealed by a first o-ring 216 disposed between the outer housing 202 and the central pin 210, a second o-ring 218 disposed between the adapter mandrel 206 and the central pin 210, and a third o-ring 220 disposed between the outer housing 202 and the adapter mandrel 206.

The outer housing 202 extends around the outer periphery of the central pin 210. The outer housing 202 is held in place relative to the central pin 210 between a retaining ring 222 and an upper shoulder 224 of the central pin 210.

The adapter mandrel 206 also extends around at least a portion of the outer periphery of the central pin 210, and the outer housing 202 extends around at least a portion of the outer periphery of the adapter mandrel 206. A lower shoulder 226 of the central pin 210 prevents the adapter mandrel 206 from downward movement relative to the central pin 210. One or more shear pins 228 hold the adapter mandrel 206 fixed in place relative to the outer housing 202. The adapter mandrel 206 is configured to be attached to the upper end of a frac plug or other downhole tool, including embodiments of downhole tools described herein. For example, the adapter mandrel 206 can be attached to the connecting portion 136 of the downhole tool 100 via one or more shear pins 152 in a manner similar to the manner in which adapter 150 is attached to the downhole tool 100 as shown in FIGS. 2 and 3.

The release tool 200 also includes an upper connecting portion 230, which can included a threaded region as shown in FIG. 4. In alternative embodiments, the connecting portion 230 can be configured for other types of attachment. The connecting portion 230 is configured to be connected to a sand line, wire line, or other cable means that can be lowered into a well bore.

The release tool 200 can be used to lower and release a frac plug or other downhole tool, and is particularly well-suited for deep-hole situations. For example, the release tool 200 is well-suited for situations where there is a limited ability to use a pull-away type of adapter (such as adapter 150) due to the length of the cable, such as depths of a mile or more.

The release process for releasing the release tool 200 will typically be commenced once the downhole tool 100 (or other connected downhole tool) is set in the well. The shear pins 228 and 152 are selected to have a shear value greater than that of the setting depth hydrostatic pressure or head pressure. For example, the shear values can be selected to be 1,000 psi greater than the head pressure. In the presence of the head pressure, which greatly exceeds the chamber pressure, the sealed chamber 214 will be urged to collapse due to the pressure differential, urging the adapter mandrel 206 to move upwardly in the direction indicated by arrow 232. This upward movement will be restrained by shear pins 228 and 152 until the head pressure exceeds the shear values. The head pressure can be increased, for example, by pumping fluid into the well from the surface. Once the head pressure reaches a high enough value, the shear pins 228 and 152 are sheared as the adapter mandrel 206 moves upwardly in the direction indicated by arrow 232. Note that the base of central pin 210 prevents the connecting portion 136 of the downhole tool 100 from moving upwardly with the adapter mandrel 206, so the shear pins 152 are severed. Once the shear pins 152 are severed, the release tool 200 is disconnected from the connecting portion 136 of the downhole tool 100, so the release tool 200 can be pulled up out of the well bore.

Figure 5:
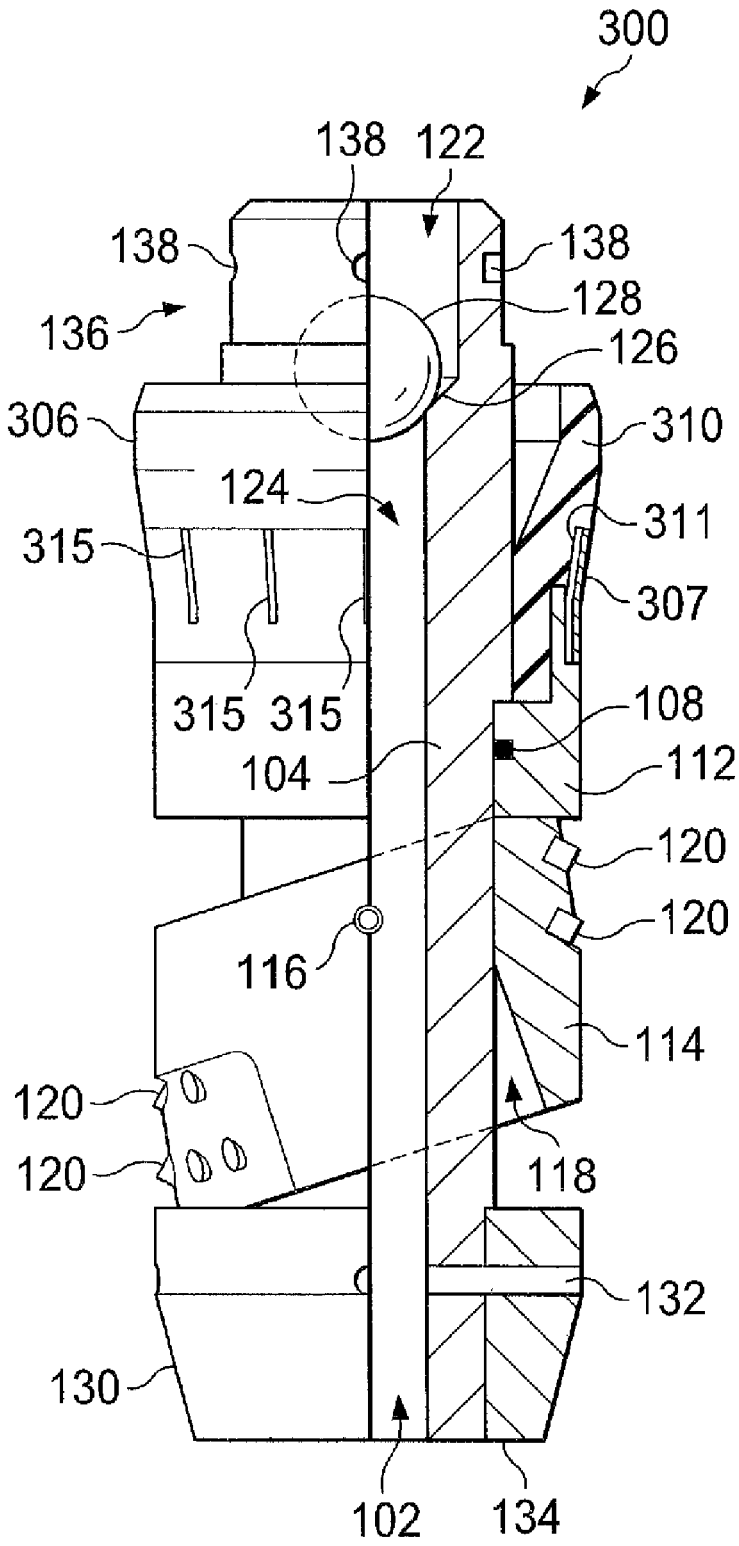
FIG. 5 shows a partly sectional view of an embodiment of a downhole tool that includes an extrusion limiter.

Turning next to FIG. 5, a downhole tool or frac plug embodiment is shown and generally designated as downhole tool 300. It will be clear to those skilled in the art that the downhole tool 300 is similar to downhole tool 100 but has at least one significant difference.

Downhole tool 300 comprises a packer cup 306. Unlike packer cup 106 of downhole tool 100, packer cup 306 includes an extrusion limiter 307. The extrusion limiter 307 comprises one or more relatively thin metal plates that extend around the outer periphery of the elastomer lip portion 310. For example the extrusion limiter 307 can be made from 16 gauge or 18 gauge sheet metal, and provided with a number of slots 315 to allow for expansion or flaring around the upper edge of the extrusion limiter 307. Unlike elastomer lip portion 110 of downhole tool 100, the outer wall 311 of elastomer lip portion 310 is recessed to accommodate the extrusion limiter 307. The extrusion limiter 307 helps to prevent the flexible elastomer lip portion 310 from folding down and failing.

Other components of the downhole tool 300 can be substantially identical to corresponding components of the downhole tool 100, and therefore the same reference numerals are shown in FIG. 5. The process of setting the downhole tool 300 is substantially the same as the process of setting the downhole tool 100 described above.

Figure 6:
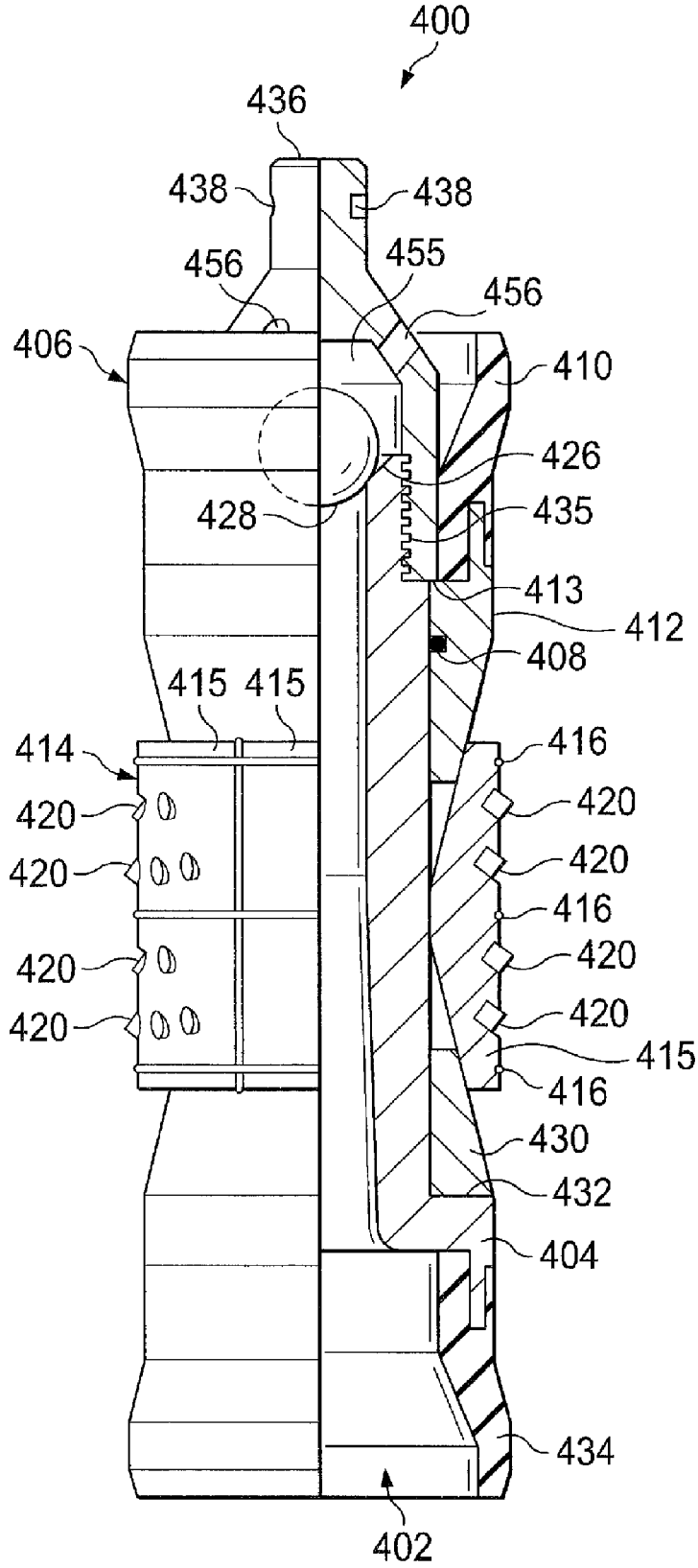
FIG. 6 shows a partly sectional view of an embodiment of a downhole tool that includes a slip wedge assembly.

Turning next to FIG. 6, a downhole tool or frac plug embodiment is shown and generally designated as downhole tool 400. Downhole tool 400 defines a central opening 402 therein. Downhole tool 400 comprises a center mandrel 404. The central opening 402 extends longitudinally through the center mandrel 404.

An upper packer cup 406 is disposed around an upper portion of mandrel 404 and generally encloses an o-ring 408. The o-ring 408 extends around the mandrel 404 and can be made of any material suitable for serving as a seal to prevent the flow of fluid between the mandrel 404 and the packer cup 406.

The packer cup 406 includes an elastomer lip portion 410 and a packer cup base 412. The packer cup 406 is a sliding packer cup 406, meaning that the packer cup 406 can slide along at least a portion of the length of the mandrel 404. A shoulder 413 of a connection adapter 436 prevents the packer cup 406 from sliding any further up the mandrel 404 from the position shown in FIG. 6. Thus, the shoulder 413 serves as a packer-cup retainer, in that the shoulder 413 helps retain the packer cup 406 onto the mandrel 404. The packer cup 406 can slide further down the mandrel 404 from the position shown in FIG. 6 when setting the downhole tool 400 as explained below.

Disposed below packer cup 406 is a wedge slip assembly 414, which serves as an example of a slip means. The wedge slip assembly 414 comprises a plurality of slip segments 415 which are positioned circumferentially about mandrel 404. Slip segments 415 may utilize ceramic buttons 420 as described in detail in U.S. Pat. No. 5,984,007 to Yuan, et al., titled "Chip resistant buttons for downhole tools having slip elements," which is hereby incorporated by reference. Slip retaining bands 416 serve to radially retain slip segments 415 in an initial circumferential position about mandrel 404. Bands 416 can be made of a steel wire, a plastic material, or a composite material having the requisite characteristics of having sufficient strength to hold the slip segments 415 in place prior to actually setting the downhole tool 400. Preferably, bands 416 are inexpensive and easily installed about slip segments 415.

The lower end of the packer cup base 412 serves also as an upper slip wedge 412. A lower slip wedge 430 is positioned partially underneath slip assembly 414. Lower slip wedge 430 is fixed in place relative to the mandrel 404 between the wedge slip assembly 414 and a mandrel shoulder 432. The mandrel shoulder 432 prevents any downward movement by the lower slip wedge 430.

A lower cup 434 is shown located below the lower slip wedge 430. However, the lower most portion of the downhole tool 400 need not be a lower cup 434, but could be a mule shoe, guide, or any type of section that serves to terminate the structure of the downhole tool 400 or serves as a connector for connecting downhole tool 400 with other tools, a valve, tubing, or other downhole equipment.

The upper end of the mandrel 404 is formed as a threaded connecting portion 435 for mating and connecting to a correspondingly-threaded connection adapter 436, which in turn is configured for mating and connecting to other tools, a valve, adapters, tubing, or other downhole equipment. The connection adapter 436 includes one or more attachment holes 438 configured to receive attachment hardware, for example bolts or pins, for securing other tools, adapters, equipment, or the like to the downhole tool 400. The upper portion of the connection adapter 436 is solid. The lower portion of the connection adapter 436 defines a chamber 455. A ball 428 is disposed within the chamber 455. Depending on the position of the ball 428, the chamber 455 can be in fluid communication with, or sealed by ball 428 from, the central opening 402 of the downhole tool 400. Specifically, the ball 428 seats against an upwardly-facing chamfered shoulder 426, which serves as a ball seat, to prevent fluid from travelling from the chamber 455 to the central opening 402. However, fluid can travel from the central opening 402 to the chamber 455 when there is sufficient pressure to lift the ball from the shoulder 426. The connection adapter 436 also includes one or more bores 456. The bores 456 provide for fluid communication between the chamber 455 and the outside of the connection adapter 436. Thus, when the connection adapter 436 is attached to the downhole tool 400, the bores 456 allow for fluid to travel from the central opening 402, upward through the chamber 455, then out of the chamber 455 through the bores 456.

The operation of downhole tool 400 is as follows. Downhole tool 400 may be lowered into a wellbore utilizing a connecting line (not shown), such as a sand line, wire line, or other cable means. As the downhole tool 400 is lowered into the well, flow therethrough will be allowed since the ball 428 is free to be lifted into the chamber 455 by the fluid, while the chamber 455 serves as a ball cage that prevents the ball 428 from moving away from ball seat shoulder 426 any further than the chamber 455 will allow. Once downhole tool 400 has been lowered to a desired position in the well bore, a differential pressure across the packer cup 406, o-ring 408, and ball 428 can be utilized to move the downhole tool 400 from its unset position to the set position. In set position, slip segments 415 and elastomer lip portion 410 engage the well casing or wall of the well bore.

The differential pressure can be applied by either pulling up on the connecting line attached to the downhole tool 400 or pumping fluid into the well bore above the downhole tool 400. Fluid weight or pump pressure will seat the ball 428 on the shoulder 426 of the mandrel 404. Fluid weight or pump pressure will also bear downwardly against the packer cup 406 and o-ring 408. The elastomer lip portion 410 of the packer cup 406 provides a pressure seal to the inside surface of the well casing or well bore wall. When this downward pressure is applied to the packer cup 406, the packer cup 406 moves downwardly, bearing against the wedge slip assembly 414 causing the retaining bands 416 to shear. The shearing of the retaining bands 416 allows the slip segments 415 to move outwardly against the well casing or well bore wall as the upper slip wedge 412 is pushed closer to the lower slip wedge 430. As the slip segments 415 move outwardly, the ceramic buttons 420 at least partially penetrate the inner surface of the well casing or well bore wall.

Once the downhole tool 400 is in a set position, the downhole tool 400 can hold fracturing pressure from above the downhole tool 400. The ball 428 will seat onto the shoulder 426 in the presence of downward pressure, thereby blocking the central opening 402 of the mandrel 404. Also, the elastomer lip portion 410 of the packer cup 406 will bear against the well casing or well bore wall in the presence of downward pressure, thereby blocking the region between the mandrel 404 and the inner surface of the well casing or well bore wall.

Figures 7A, 7B:
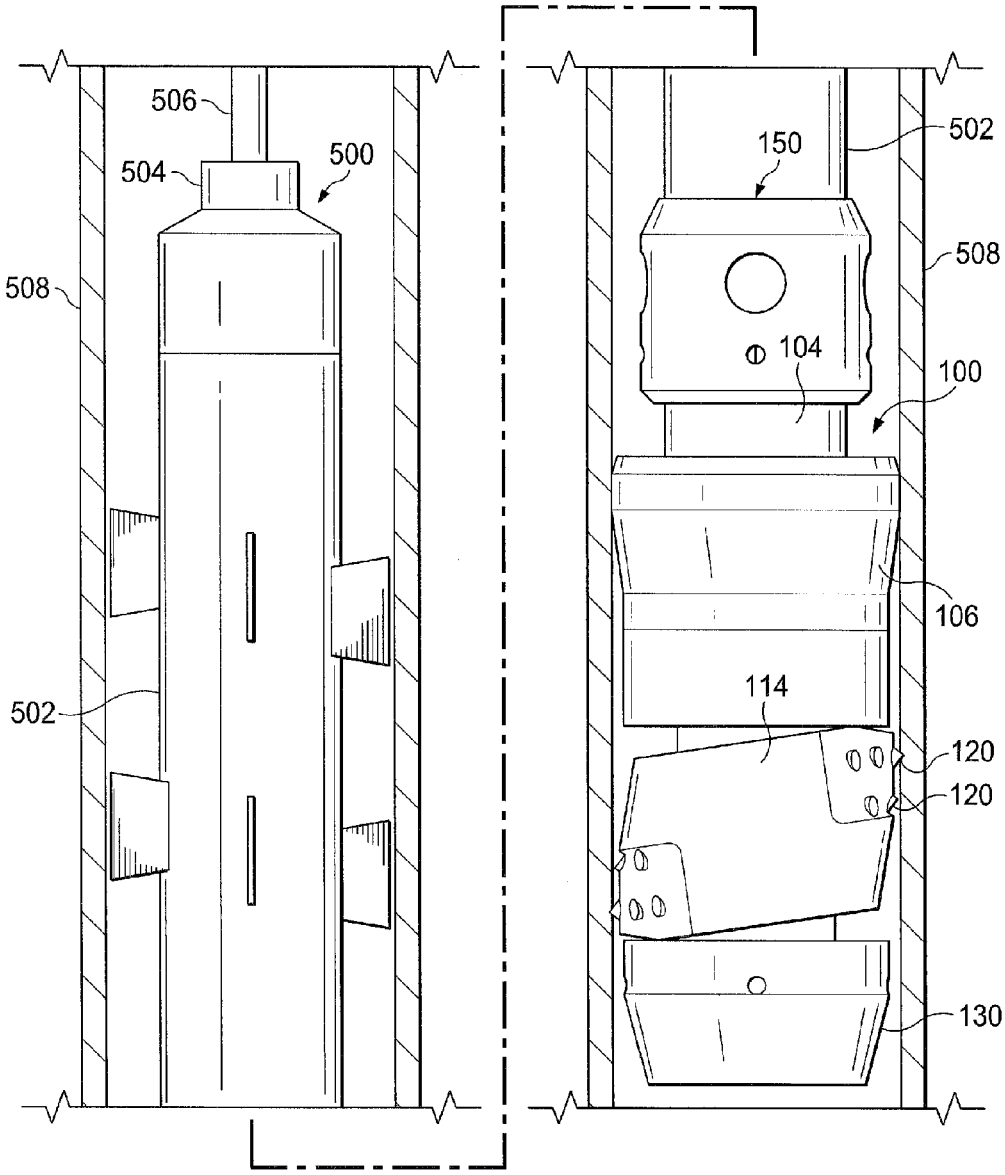
FIGS. 7A and 7B show the downhole tool of FIGS. 1-3 attached to a perforating tool.

Turning next to FIGS. 7A and 7B, a method of running a single trip with wireline perforating guns and a frac plug or bridge plug will now be described. FIGS. 7A and 7B show the downhole tool 100, which serves here as a frac plug, attached to a perforating tool 500, which can also serve as an example of a setting apparatus. While this method is being described with reference to downhole tool 100, other downhole tools described herein can be similarly used in place of downhole tool 100.

The perforating tool 500 can include components of conventional perforating tools that are well known in the art. For example, the perforating tool 500 includes a perforating gun assembly 502 and a rope socket/firing head assembly 504 that are connected to a wireline 506.

The downhole tool 100 is attached to the bottom of the perforating tool 500 via a shearable setting adapter 150. Other adapters or release tools, including those disclosed herein, can be used to connect the downhole tool 100 to the perforating tool 500. This assembly is lowered into a well bore 508 to the desired setting depth. The downhole tool 100 is set, for example as described above. The perforating tool 500 is separated from the downhole tool 100 by releasing the shearable setting adapter 150 from the downhole tool 100 as described above. The well bore 508 may or may not be pressure tested. A signal is sent to the perforating gun assembly 502 via the wireline 506 to fire the perforating charges. The perforating tool 500 and setting adapter 150 are then removed from the well bore 508. This method advantageously eliminates the need for a separate, second electrical pressure-setting charge that prior systems used for sealing the well bore prior to firing the perforating charges. Since the presently disclosed method does not require an electric charge for setting a packer or frac plug, the present method also eliminates the need to provide for discrimination between two different charges (e.g., positive and negative charges). Such discrimination was required by prior systems in order to prevent the perforating charges from firing before the frac plug is set.

Turning next to FIGS. 8A-8F, a downhole tool or frac plug embodiment is shown and generally designated as downhole tool 600. The downhole tool 600 has a central opening 602 and a mandrel 604, where the central opening extends longitudinally through the mandrel 604. The mandrel 604 is attached to a setting tool 700 via one or more shear pins 652. The setting tool 700 serves as an example of a setting apparatus. It will be clear to those skilled in the art that the downhole tool 600 is similar to downhole tool 100, but has a few significant differences.

Downhole tool 600 comprises a retractable packer cup 606. Unlike packer cup 106 of downhole tool 100, packer cup 606 includes a lip sleeve 607. The lip sleeve 607 is attached, for example using an adhesive, to a retractable elastomer lip portion 610. The retractable elastomer lip portion 610 is retractable in that it is configured to retract from the unset position shown in FIG. 8B to the set position shown in FIG. 8F as described below.

Figure 8A:
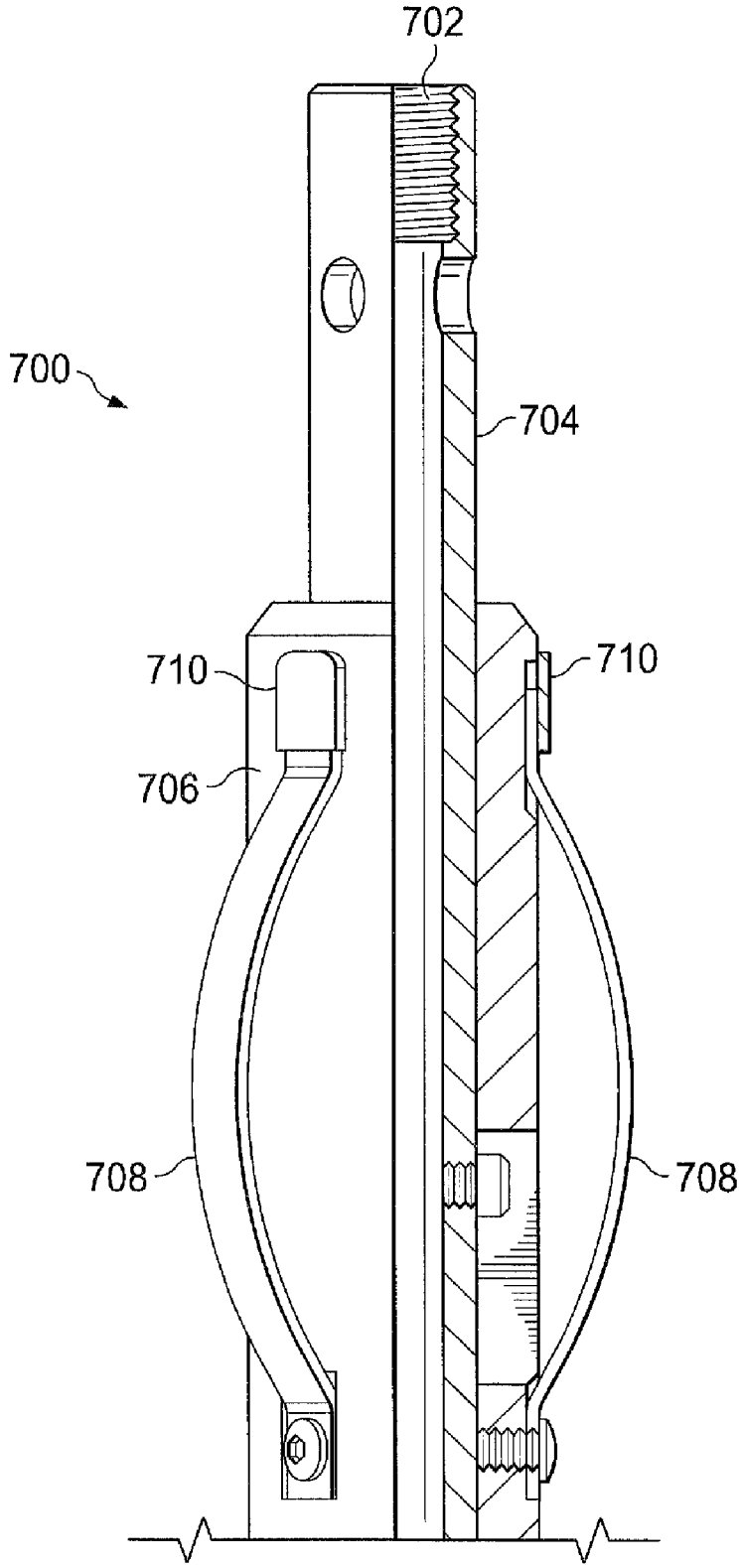
FIGS. 8A and 8B a partly sectional view of a setting tool attached to an embodiment of a downhole tool that includes a retractable packer cup.
Figure 8B:
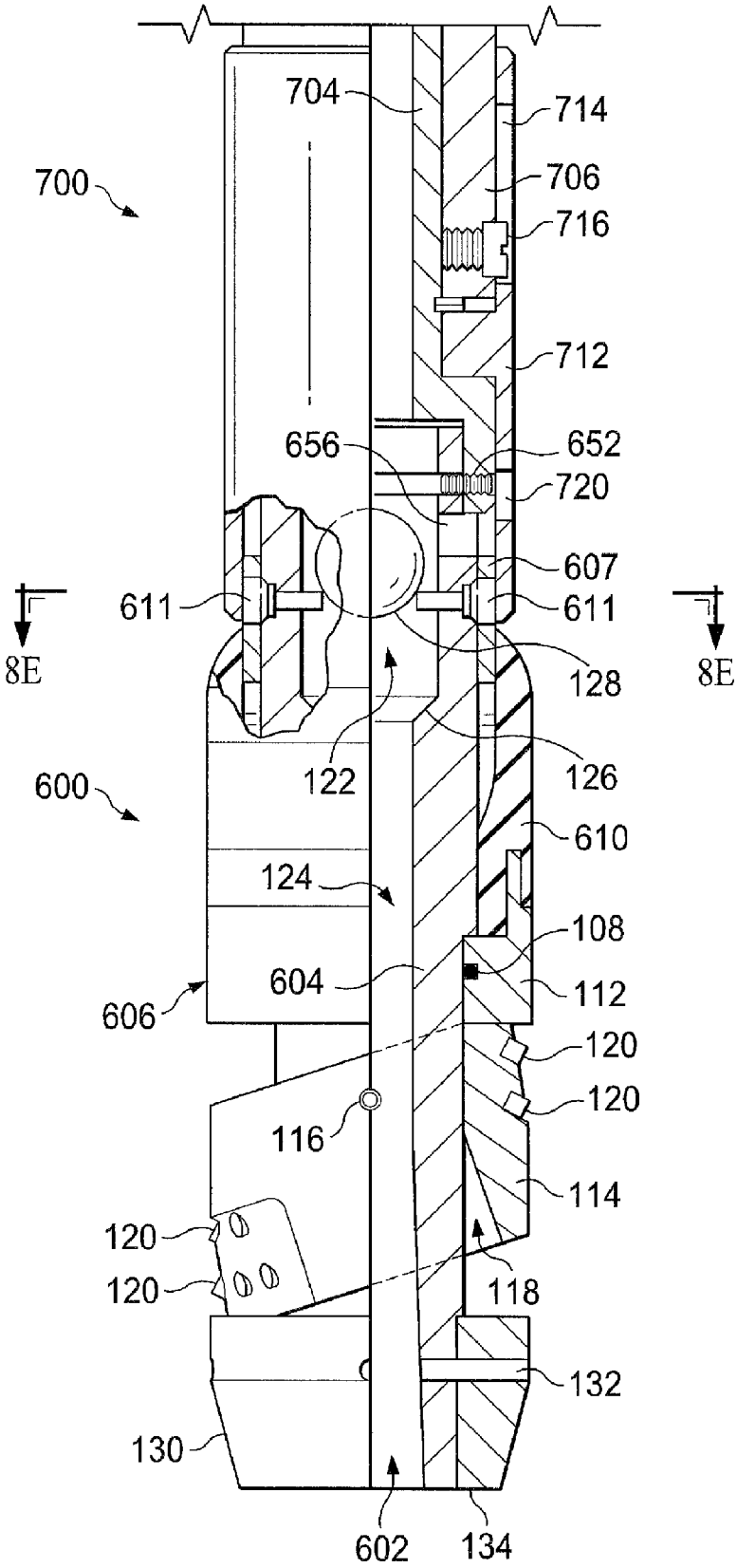
Figure 8C:
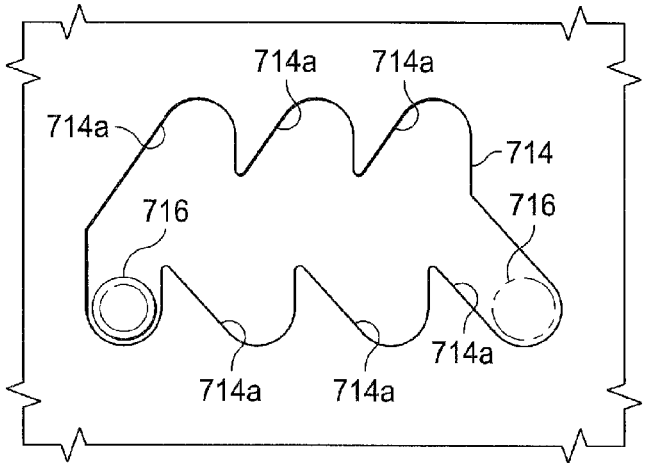
FIG. 8C shows an embodiment of an index slot for the setting tool shown in FIGS. 8A and 8B.
Figure 8D:
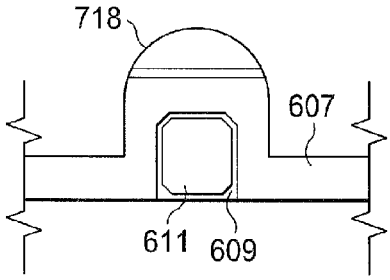
FIG. 8D shows a plan view of a locking dog release slot of the setting tool shown in FIGS. 8A and 8B aligned for releasing a locking dog.
Figure 8E:
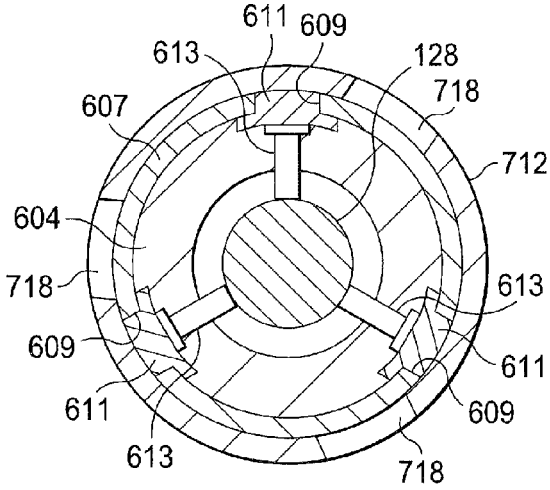
FIG. 8E shows a cross-sectional view of the downhole tool taken along section lines 8E-8E shown in FIG. 8B.

Referring specifically now FIGS. 8B and 8E, FIG. 8E shows a cross-sectional view of the downhole tool 600 taken along section lines 8E-8E in FIG. 8B. The lip sleeve 607 extends around the outer periphery of the mandrel 604 of the downhole tool 600. The lip sleeve 607 has a plurality of locking dog slots 609 formed therein, each locking dog slot 609 housing a respective locking dog 611. When the downhole tool 600 is in an unset position as shown in FIG. 8B, each locking dog 611 holds a respective ball pin 613 in position such that the ball pins 613 extend into the upper opening portion 122, where the ball pins 613 keep the ball 128 positioned above the ball seat shoulder 126.

Other components of the downhole tool 600 can be substantially identical to corresponding components of the downhole tool 100, and therefore the same reference numerals are shown in FIGS. 8A-8F.

The setting tool 700 includes defines a central opening 702 therein. Setting tool 700 comprises a center mandrel 704. The central opening 702 extends longitudinally through the center mandrel 704.

A friction spring carrier 706 is disposed around mandrel 704. A plurality of friction springs 708 are attached around the periphery of the friction spring carrier 706. The friction springs 708 are resilient members that bow outwardly from the outer surface of the friction spring carrier 706 and are configured to act as leaf springs to assist in keeping the setting tool 700 centered in a well bore or well casing. A lower end of each friction spring 708 is attached to the friction spring carrier 706, for example using bolts or other such mounting hardware. An upper end of each friction spring extends into a respective spring slot 710, which allows room for the friction spring 708 to extend and retract as needed. Alternatively, the upper ends of the friction springs 708 can be fixed and the lower ends can be slidable.

An index sleeve 712 is disposed around the lower end of the friction spring carrier 706 and the upper end of the mandrel 604 of the downhole tool 600. The index sleeve 712 has at least one index slot 714 that extends therethrough. FIG. 8C shows a plan view of the index slot 714. An index pin 716 is attached to the friction spring carrier 706 and extends into the index slot 714. In some embodiments, the index sleeve 712 can have two identical index slots 714 formed in opposing sides of the index sleeve 712. The index sleeve 712 also has a plurality of locking dog release slots 718 that extend therethrough as best shown in FIG. 8E. At least one locking dog release slot 718 is provided for each locking dog 611.

In an unset position, each locking dog release slots 718 is offset from a respective locking dog 611. In a set position, each locking dog release slot 718 is aligned with a respective locking dog 611. FIG. 8D shows a plan view of a locking dog release slot 718 aligned with a locking dog 611, as would be the case for the set position shown in FIG. 8F. Thus, the index sleeve 712 should be rotated about the friction spring carrier 706 and mandrel 604 in order to set the downhole tool 600. The index slot 714 allows the index sleeve 712 to be rotated from above the well as described below.

Referring specifically to FIG. 8B, the retractable packer cup 606 is set to the illustrated unset position prior to lowering the downhole tool 600 into a well bore. The retractable packer cup 606 is squeezed inward, causing the lip sleeve 607 to slide upward to the position shown in FIG. 8B. This allows the locking dogs 611 to seat in the locking dog slots 609 in the mandrel 604. The setting tool 700 is attached to the downhole tool 600 using shear pins 652, and the index sleeve 712 is positioned on top of the locking dogs 611, with the release slots 718 offset from the locking dogs 611, thereby securing the locking dogs 611 in respective slots 609. This locks the ball pins 613 in place under the ball 128, which prevents the ball 128 from seating on shoulder 126. The downhole tool 600 is lowered into a well bore in this unset position, and as the downhole tool 600 is lowered, fluid can travel around the outside of the downhole tool 600 and through the central opening 602, around the ball 128, and out bypass holes 656 and 720 in the mandrel 604 and index sleeve 712, respectively.

Once the downhole tool 600 is lowered to the desired setting depth, the process of setting the downhole tool 600 can begin. The setting tool 700 is raised and lowered from above via a connecting line (not shown), such as a sand line, wire line, or other cable means, supporting the upper end of the setting tool 700. As the setting tool 700 is raised and lowered, the index pin 716 is raised and lowered in the index slot 714. The index slot 714 includes a plurality of contact surfaces 714*a* that extend at a non-zero angle relative to the upward and downward travel directions of the index pin 716. Each time the index pin 716 is raised or lowered, the index pin 716 urges against a subsequent contact surface 714*a*. The angle of the contact surface 714*a* is such that the index sleeve 712 is caused to rotate as the index pin 716 is raised or lowered in the index slot 714. In the embodiment shown in FIG. 8C, the index pin 716 is shown in solid lines in the unset position and in broken lines in the set position. In this embodiment, the setting tool 700 can be raised and lowered three times each before the downhole tool 600 will be set. In alternative embodiments, the index slot 714 can include more or fewer contact surfaces, thus requiring more or fewer times that the setting tool 700 can be raised and lowered before the downhole tool 600 is set.

Figure 8F:
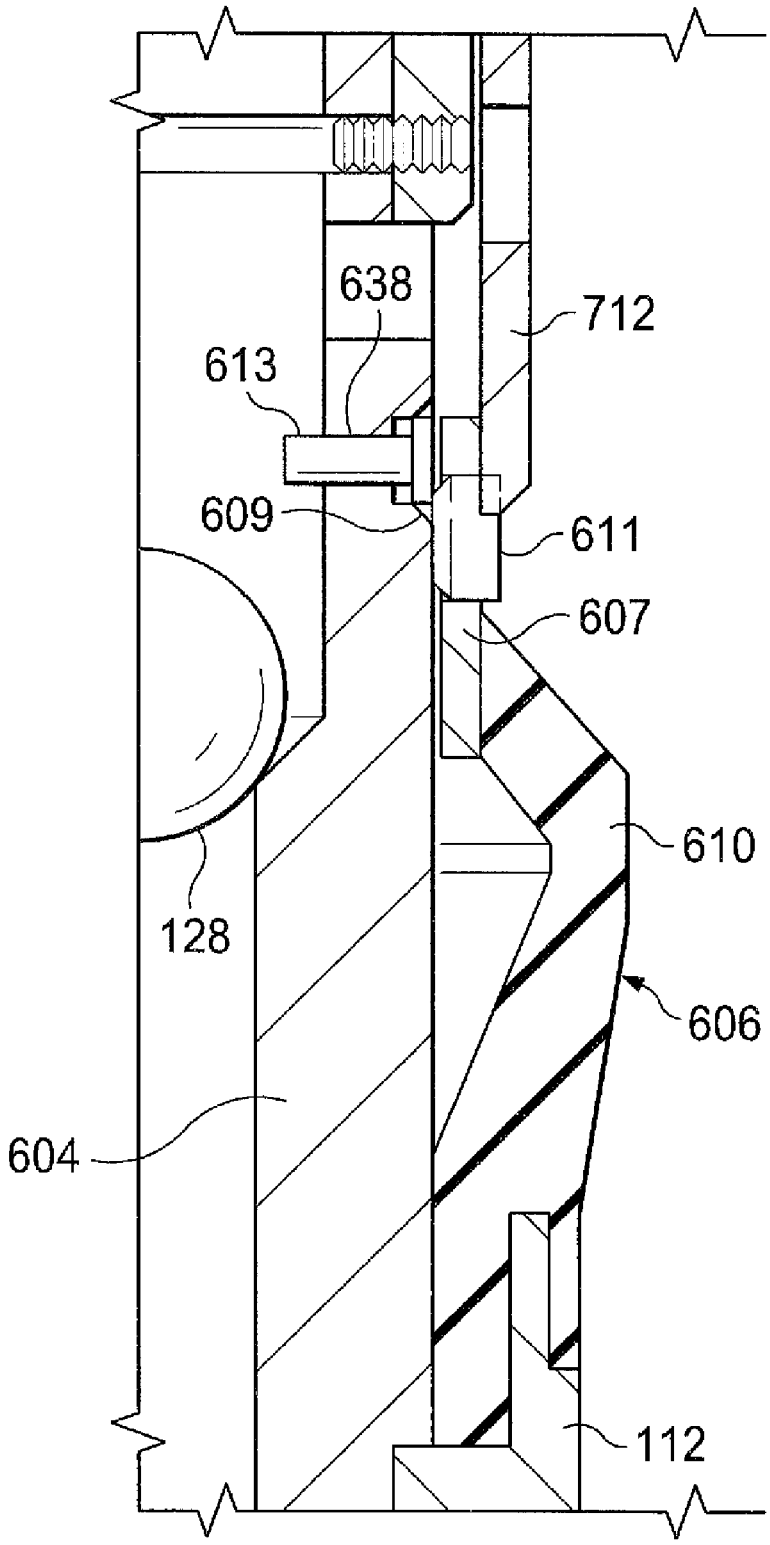
FIG. 8F shows an enlarged sectional view of the downhole tool shown in FIGS. 8A and 8B in a set position.

Once the setting tool 700 has been raised and lowered the requisite number of times, the index sleeve 712 will be rotated to the point where the locking dog release slots 718 are aligned with respective locking dogs 611 as shown in FIG. 8D. This allows the locking dogs 611 to be released from respective locking dog slots 609. The retractable packer cup 606 is made of an elastomer material and is designed to urge to the expanded position shown in FIG. 8F. Thus, once the locking dogs 611 are released, the retractable packer cup 606 urges the lip sleeve 607 downward and the retractable packer cup 606 expands to contact the inner surface of the well bore. Also, once the locking dogs 611 are released, the ball pins 613 are also released and free to be pushed into pin holes 638 in the mandrel 604 under the weight and wedging action of the ball 128 as shown in FIG. 8F. Subsequent fluid weight or pump pressure will seat the ball 128 on the shoulder 126 of the mandrel 604. From this point, the downhole tool 600 can be set using differential pressure to push the packer cup 606 downward, shear the shear pin 116, and rotate the slip 114 into a set position in a manner substantially the same as described above in connection with FIG. 3. The setting tool 700 can then be separated from the downhole tool 600 by pulling up with enough force to break the shear pins 652, at which point the setting tool 700 can be raised and removed from the well bore, leaving the downhole tool 600 set in and sealing the well bore.

Figure 9A:
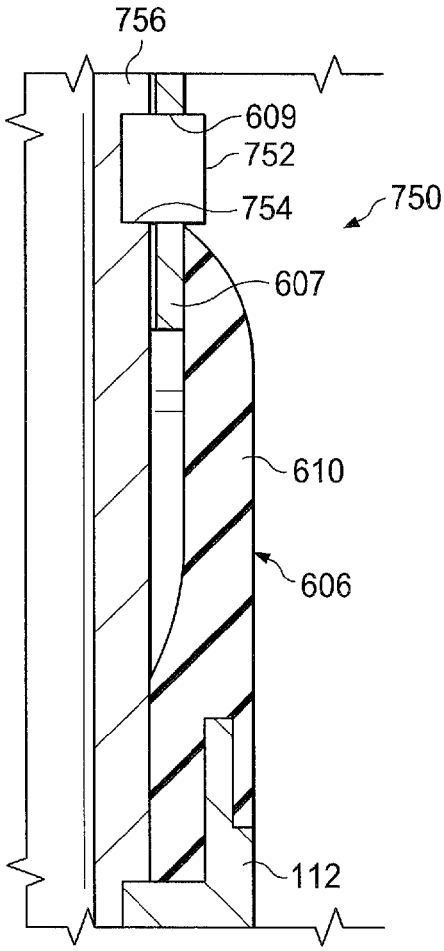
FIGS. 9A and 9B show enlarged sectional views of unset and set positions, respectively, of an alternative embodiment to the downhole tool shown in FIGS. 8A and 8B that uses soluble locking dogs.
Figure 9B:
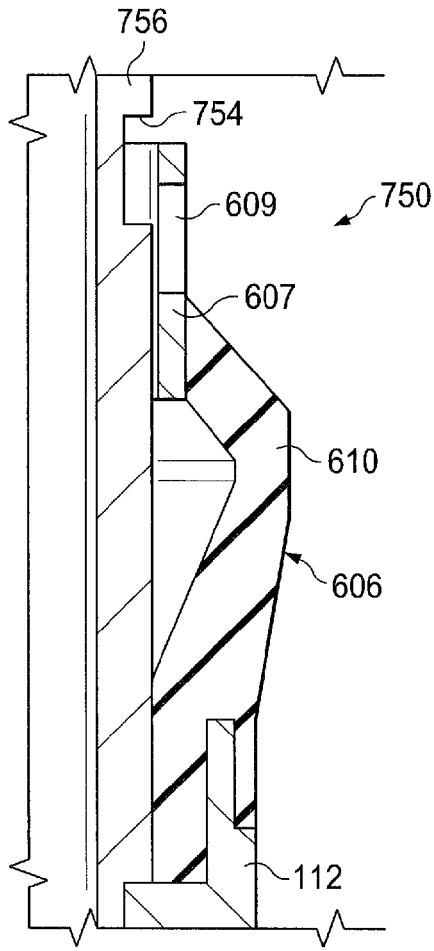

Turning next to FIGS. 9A and 9B, partially sectioned views are shown of a portion of a downhole tool 750, which can be a modified version of downhole tool 600. The downhole tool 750 can be substantially identical to downhole tool 600, with a couple of significant differences.

The downhole tool 750 comprises a retractable packer cup 606. Packer cup 606 includes a lip sleeve 607. The lip sleeve 607 is attached to a retractable elastomer lip portion 610. The retractable elastomer lip portion 610 is retractable in that it can be retracted from the unset position shown in FIG. 9A to the set position shown in FIG. 9B. The packer cup 606, lip sleeve 607, and elastomer lip portion 610 can be substantially identical to corresponding components of the downhole tool 600, and therefore the same reference numerals are shown in FIGS. 9A and 9B. However, unlike downhole tool 600, the downhole tool 750 includes soluble locking dogs 752 in place of locking dogs 611. The soluble locking dogs 752 are glued in place, as shown in FIG. 9A, each extending through a respective locking dog slot 609 and into a respective recess 754 in the mandrel 756. The soluble locking dogs 752 dissolve in the well fluids after the downhole tool 750 is lowered into a well bore. The soluble locking dogs 752 can be formed of, or at least include, a soluble material. Examples of suitable soluble materials include water soluble polymers containing hydroxyl, such as hydroxylcellulose. Other examples of suitable soluble material are disclosed in U.S. Pat. No. 5,948,848 to Giltsoff, titled "Biodegradable plastic material and a method for its manufacture," which is hereby incorporated by reference. Once the soluble locking dogs 752 are dissolved, the lip sleeve 607 is released allowing the retractable elastomer lip portion 610 to move to the position shown in FIG. 9B.

From this point, the downhole tool 750 can be set using differential pressure to push the packer cup 606 downward, shear the shear pin 116, and rotate the slip 114 into a set position in a manner substantially the same as described above in connection with FIG. 3. Since the downhole tool 750 uses soluble locking dogs 752, the setting tool 700 with the indexing sleeve 712 is not needed for releasing the locking dogs 752. Thus, the downhole tool 750 can be configured for use with other types of setting adapters and/or release tools, for example adapter 150 or release tool 200.

Also, in some embodiments, the downhole tool 750 can be a bridge plug having a solid mandrel in place of the mandrel 604. In such embodiments, the solid mandrel does not include a central fluid path such as central opening 602. Such embodiments do not require a ball 128 since there is no central fluid path for the ball 128 to block.

Turning next to FIGS. 10A-10E, partially sectioned views are shown of a portion of downhole tool 600 attached to a setting tool 800 via one or more shear pins 652. It will be clear to those skilled in the art that the setting tool 800 is similar to setting tool 700, but has a few significant differences. The setting tool 800 serves as an example of a setting apparatus.

The setting tool 800 includes defines a central opening 802 therein. Setting tool 800 comprises a center mandrel 804. The central opening 802 extends longitudinally through the center mandrel 804.

A friction spring carrier 706 is disposed around mandrel 804 and can be substantially identical to the friction spring carrier 706 of setting tool 700, and therefore retains the same reference number.

Figure 10B:
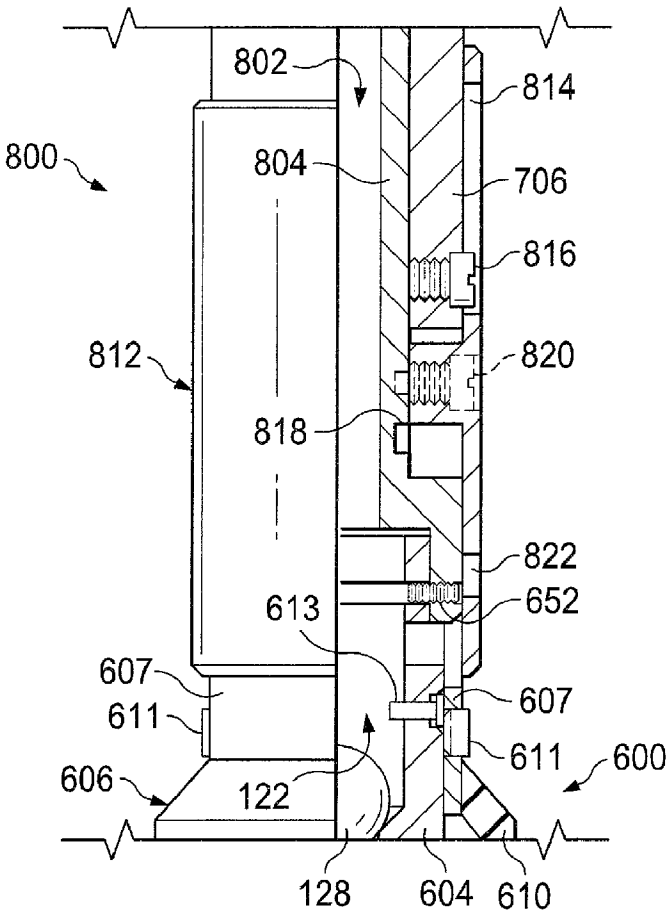
FIGS. 10A and 10B show partly sectional views of unset and set positions, respectively, of the downhole tool shown in FIGS. 8A and 8B attached to an alternative setting tool.

An index sleeve 812 is disposed around the lower end of the friction spring carrier 706 and the upper end of the mandrel 604 of the downhole tool 600. The index sleeve 812 has at least one index slot 814 that extends therethrough. FIG. 10C shows a plan view of the index slot 814. An index pin 816 is attached to the friction spring carrier 706 and extends into the index slot 814. In some embodiments, the index sleeve 812 can have two identical index slots 814 formed in opposing sides of the index sleeve 812. Unlike the index sleeve 712, the index sleeve 812 does not include locking dog release slots 718 that extend therethrough for reasons that will become clearer based on the description of the operation of setting tool 800 provided below.

At least one L-slot 818 is formed in the outside surface of the mandrel 804. In some embodiments, for example, identical L-slots 818 can be formed in opposing sides of the mandrel 804. FIG. 10E shows a plan view of the L-slot 818. An L-slot pin 820 for each L-slot 818 is attached to the index sleeve 812 and extends into the respective L-slot 818.

Figure 10A:
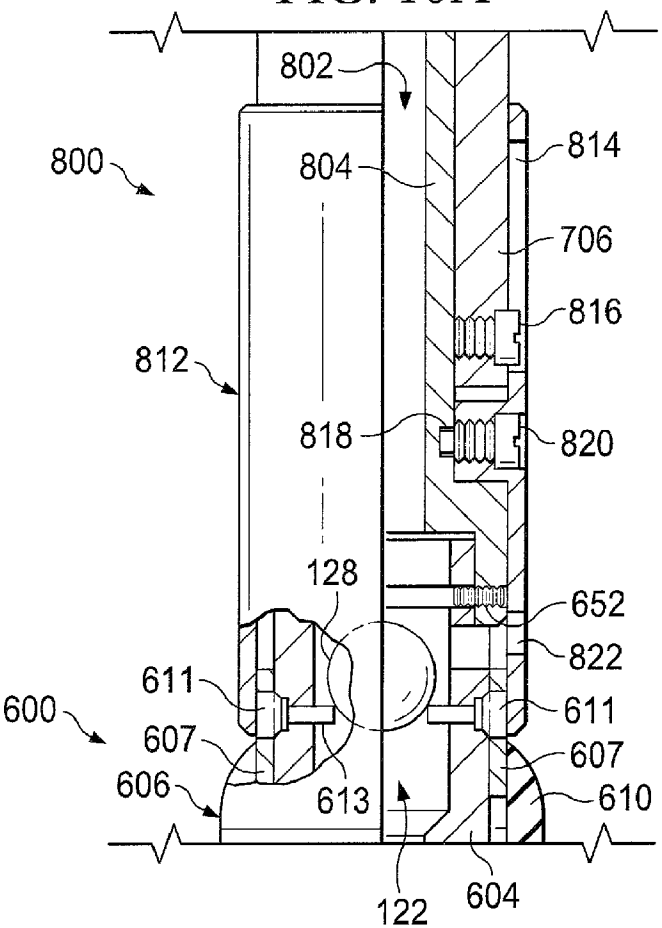
Figure 10C:
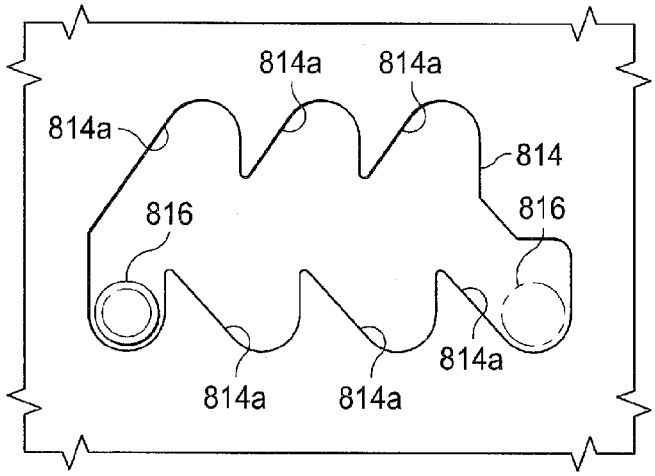
FIG. 10C shows an embodiment of an index slot for the setting tool shown in FIGS. 10A and 10B.

Referring specifically to FIG. 10A, the retractable packer cup 606 is set to the illustrated unset position prior to lowering the downhole tool 600 into a well bore. The retractable packer cup 606 is squeezed inward, causing the lip sleeve 607 to slide upward to the position shown in FIG. 10A. This allows the locking dogs 611 to seat in the locking dog slots 609 in the mandrel 604. The setting tool 800 is attached to the downhole tool 600 using shear pins 652, and the index sleeve 812 is positioned on top of the locking dogs 611, thereby securing the locking dogs 611 in respective slots 609. This locks the ball pins 613 in place under the ball 128, which prevents the ball 128 from seating on shoulder 126. The downhole tool 600 is lowered into a well bore in this unset position, and as the downhole tool 600 is lowered, fluid can travel around the outside of the downhole tool 600 and through the central opening 602, around the ball 128, and out bypass holes 656 and 822 in the mandrel 604 and index sleeve 812, respectively.

Once the downhole tool 600 is lowered to the desired setting depth, the process of setting the downhole tool 600 can begin. The setting tool 800 is raised and lowered from above via a connecting line (not shown), such as a sand line, wire line, or other cable means, supporting the upper end of the setting tool 800. As the setting tool 800 is raised and lowered, the index pin 816 is raised and lowered in the index slot 814. The index slot 814 includes a plurality of contact surfaces 814*a* that extend at a non-zero angle relative to the upward and downward travel directions of the index pin 816. Each time the index pin 816 is raised or lowered, the index pin 816 urges against a subsequent contact surface 814*a*. The angle of the contact surface 814*a* is such that the index sleeve 812 is caused to rotate as the index pin 816 is raised or lowered in the index slot 814. In the embodiment shown in FIG. 10C, the index pin 816 is shown in solid lines in the unset position and in broken lines in the set position. In this embodiment, the setting tool 800 can be raised and lowered three times each before the downhole tool 600 will be set. In alternative embodiments, the index slot 814 can include more or fewer contact surfaces, thus requiring more or fewer times that the setting tool 800 can be raised and lowered before the downhole tool 600 is set.

As the setting tool 800 is being raised and lowered, the index sleeve 812 rotates about the mandrel 804. The L-slot pin 820 is attached to the index sleeve 812, so as the index sleeve 812 rotates, the L-slot pin 820 travels along the L-slot 818 in the direction indicated by arrow 824 in FIG. 10E. Once the setting tool 800 has been raised and lowered the requisite number of times, the index sleeve 812 will be rotated to a position where the L-slot pin 820 is located at position 826 in FIG. 10E. From position 828, the L-slot pin 820 is free to travel in an upwards direction by arrow 828 from position 828 to position 830. Since the L-slot pin 820 is fixed relative to the index sleeve 812, this means that the index sleeve 812 can also be moved in the same upwards direction from the position shown in FIG. 10A to the position shown in FIG. 10B.

Figure 10D:
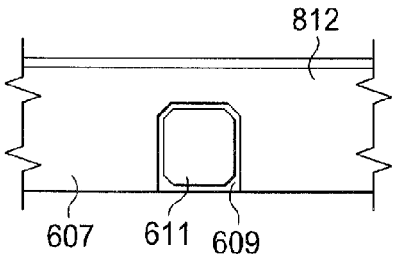
FIG. 10D shows a plan view of a locking dog relative to the setting tool shown in FIGS. 10A and 10B aligned for releasing the locking dog.
Figure 10E:
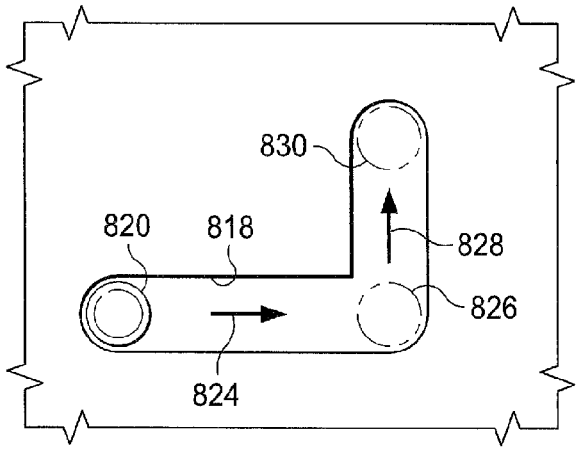
FIG. 10E shows a plan view of an L-slot for the setting tool shown in FIGS. 10A and 10B.

Once the index sleeve 812 has been raised to the position shown in FIG. 10B, the index sleeve 812 no longer blocks the locking dogs 611 as shown in FIG. 10D. This allows the locking dogs 611 to be released from respective locking dog slots 609. The retractable packer cup 606 is made of an elastomer material and is designed to urge to an expanded position (also shown in FIG. 8F). Thus, once the locking dogs 611 are released, the retractable packer cup 606 urges the lip sleeve 607 downward and the retractable packer cup 606 expands to contact the inner surface of the well bore. Also, once the locking dogs 611 are released, the ball pins 613 are also released and free to be pushed into pin holes 638 in the mandrel 604 under the weight and wedging action of the ball 128. Subsequent fluid weight or pump pressure will seat the ball 128 on the shoulder 126 of the mandrel 604. From this point, the downhole tool 600 can be set using differential pressure to push the packer cup 606 downward, shear the shear pin 116, and rotate the slip 114 into a set position in a manner substantially the same as described above in connection with FIG. 3. The setting tool 800 can then be separated from the downhole tool 600 by pulling up with enough force to break the shear pins 652, at which point the setting tool 800 can be raised and removed from the well bore, leaving the downhole tool 600 set in and sealing the well bore.

Figure 11B:
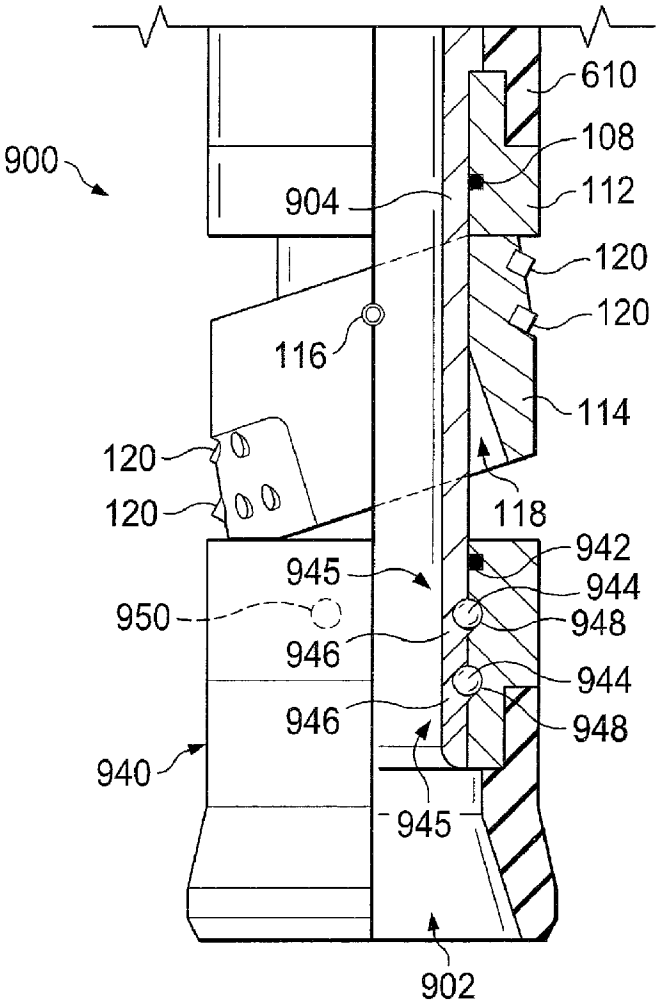
FIGS. 11A and 11B show a partly sectional view of an embodiment of a downhole tool that includes twist-lock connection means and a lower packer cup.
Figure 11A:
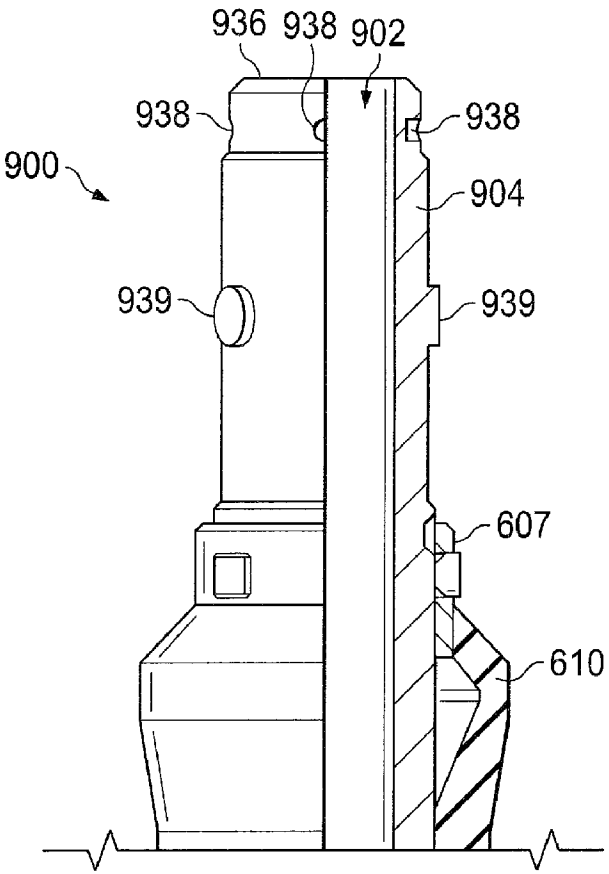

Turning next to FIGS. 11A and 11B, a downhole tool embodiment is shown and generally designated as downhole tool 900. The downhole tool 900 is particularly well suited for use as a production packer or injection packer. For example, the downhole tool 900 can be used for water flooding or carbon dioxide flooding. Downhole tool 900 can include components made of corrosive resistant composite materials, for example fiberglass, allowing the downhole tool 900 to be useful in corrosive applications. It will be clear to those skilled in the art that the downhole tool 900 is similar to downhole tools 100 and 600, but has a few significant differences.

The downhole tool 900 includes a packer cup 606 having a retractable elastomer lip portion 610. The packer cup 606 includes a lip sleeve 607. The lip sleeve 607 is attached to the retractable elastomer lip portion 610. The retractable elastomer lip portion 610 is retractable in that it can be retracted from an unset position (shown in FIG. 8B) to the set position shown in FIGS. 11A and 11B (also shown in FIG. 8F). The packer cup 606, lip sleeve 607, and elastomer lip portion 610 can be substantially identical to corresponding components of the downhole tool 600, and therefore the same reference numerals are shown in FIGS. 11A and 11B.

As with downhole tool 600, the downhole tool 900 includes a lip sleeve 607 that has a plurality of locking dog slots 609 formed therein, where each locking dog slot 609 is configured for housing a respective locking dog 611 while the downhole tool 900 is in an unset position. The retractable elastomer lip portion 610 is a resilient member that is configured to urge towards the set position, pulling downward on the lip sleeve 607. The locking dogs 611 can be held in respective locking dog slots 609 in order to act against the pulling of the retractable elastomer lip portion 610 on the lip sleeve 607 in order to maintain the downhole tool 900 in an unset position. Thus, the downhole tool 900 can be used with setting tool 700 or setting tool 800 in order to hold the locking dogs 611 in respective locking dog slots 609 until the downhole tool 900 is lowered to a desired setting depth. Alternatively, the downhole tool 900 can include soluble locking dogs 752 as described above in connection with FIGS. 9A and 9B.

Downhole tool 900 comprises a center mandrel 904. A central opening 902 extends longitudinally through the center mandrel 904. The packer cup 906 is disposed around a central portion of mandrel 904 and generally encloses an o-ring 108. The o-ring 108 extends around the mandrel 904 and can be made of any material suitable for serving as a seal to prevent the flow of fluid between the mandrel 904 and the packer cup 606.

Disposed below packer cup 606 is a slip 114. The slip 114 is initially held in place by a retaining means, such as shear pin 116 or the like. The slip 114 can be substantially identical to the slip 114 described above in connection with downhole tool 100, and therefore retains the same reference number.

The upper end of the mandrel 904 is formed as a connecting portion 936 for mating and connecting to other tools, a valve, adapters, tubing, or other downhole equipment. The connecting portion 936 includes one or more attachment holes 938 configured to receive attachment hardware, for example bolts or pins, for securing other tools, adapters, equipment, or the like to the mandrel 904. The connecting portion 936 also includes twist-lock pins 939 formed on, or attached to, the outer surface of the connecting portion 936 of the mandrel 904. The twist-lock pins 939 allow the connecting portion 936 to serve as an on/off tool for connecting the downhole tool 900 with tubing (not shown) that is designed to be attached to a downhole tool via a twist-lock latching mechanism.

A lower cup 940 is disposed below packer cup 606. However, the lower most portion of the downhole tool 900 need not be a lower cup 940, but could be a mule shoe, guide, or any type of section that serves to terminate the structure of the downhole tool 900 or serves as a connector for connecting downhole tool 900 with other tools, a valve, tubing, or other downhole equipment. At least the upper portion of the lower cup 940 is disposed around mandrel 904 and generally encloses an o-ring 942 and a plurality of locking balls 944. The o-ring 942 extends around the mandrel 904 and can be made of any material suitable for serving as a seal to prevent the flow of fluid between the mandrel 904 and the lower cup 940.

The locking balls 944 are disposed in a ball track 945 that is created by aligning a first groove 946, which is formed in the outer surface of the mandrel 904, with a second groove 948, which is formed in the inner surface of the lower cup 940. One or more ball tracks 945 can be provided. The lower cup 940 is slid in place over the lower end of the mandrel 904 and rotated so that the first groove 946 aligns with the second groove 948. A temporary port 950 extends through the lower cup 940 to the ball track 945. Locking balls 944 can be inserted through the port 950 until the ball track 945 is at least somewhat full. The temporary port 950 is then sealed, for example using a plug or sealant material, to prevent the locking balls 944 from exiting the ball track 945. The ball track 945 is preferably at least somewhat helical so that, when the ball track 945 is filled with the locking balls 944, the lower cup 940 is both longitudinally and rotationally fixed in place relative to the mandrel 904.

Alternative embodiments, such as the embodiment described below in connection with FIG. 12, can include alternative means for attaching the lower cup 940. The configuration of the lower end of the mandrel 904 can vary depending on the attachment method. For example, the lower end of the mandrel 904 can alternatively be threaded instead of having the ball groove 946 formed therein in order to allow the lower cup 940 to be threaded onto the lower end of the mandrel 904 instead of being attached using the locking balls 944.

Other components of the downhole tool 900 can be substantially identical to corresponding components of the downhole tool 600, and therefore the same reference numerals are shown in FIGS. 11A and 11B. The process of setting the downhole tool 900 is substantially the same as the process of setting the downhole tool 600 described above.

Figure 12:
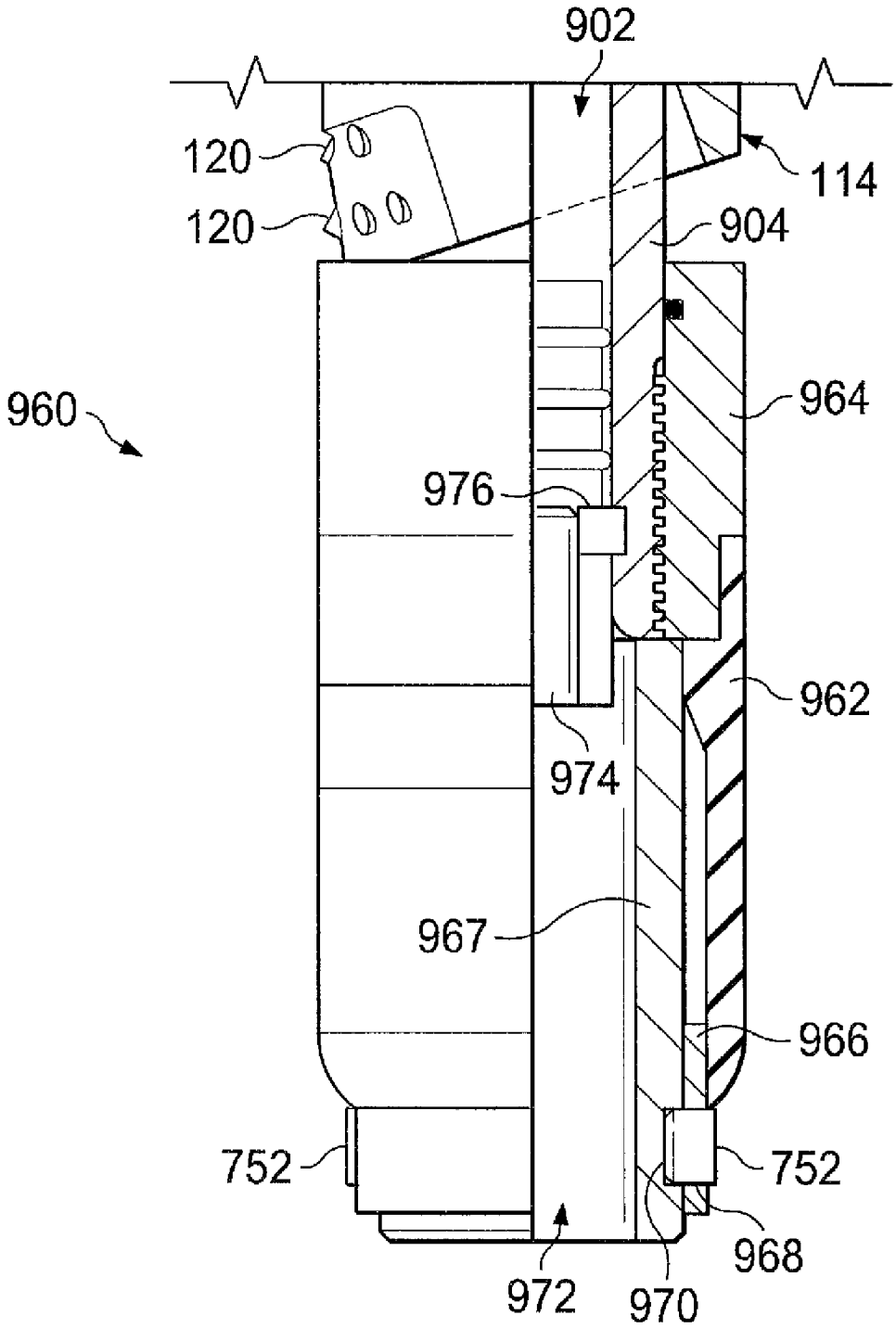
FIG. 12 shows an alternative lower cup for the downhole tool shown in FIGS. 11A and 11B.
Figure 13A:
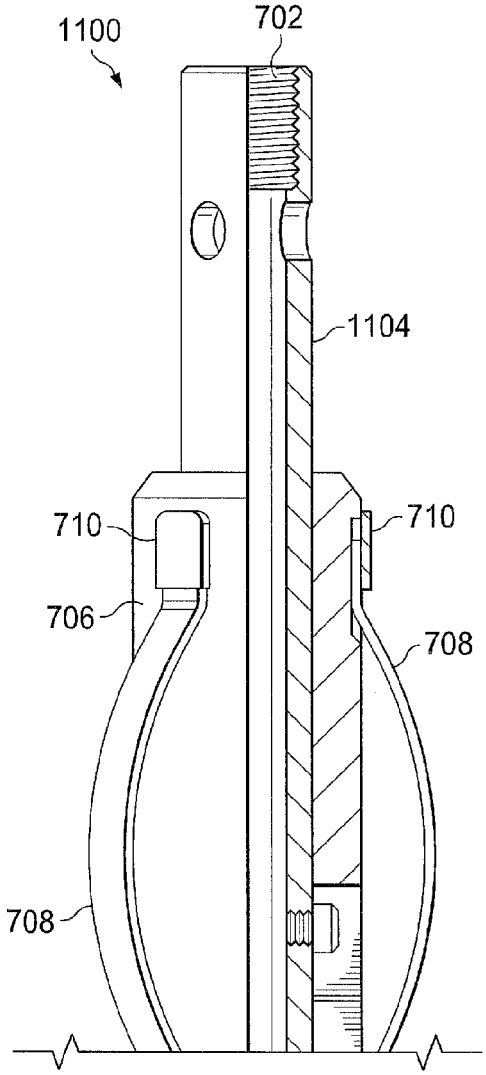
FIGS. 13A-13D show a partly sectional view of a setting tool attached to an embodiment of a downhole tool that includes a collet.
Figure 13B:
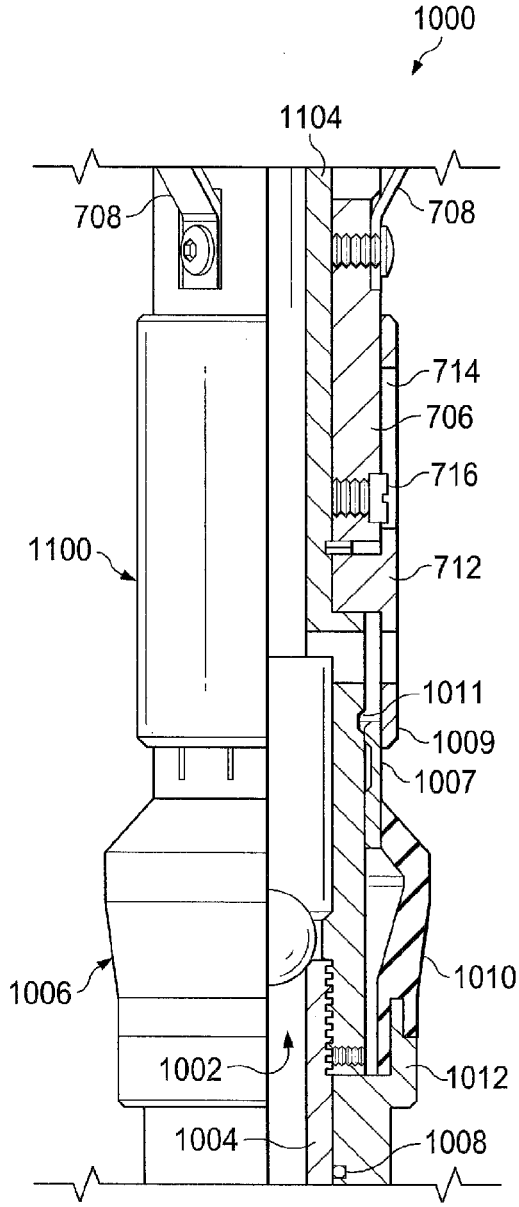
Figure 13C:
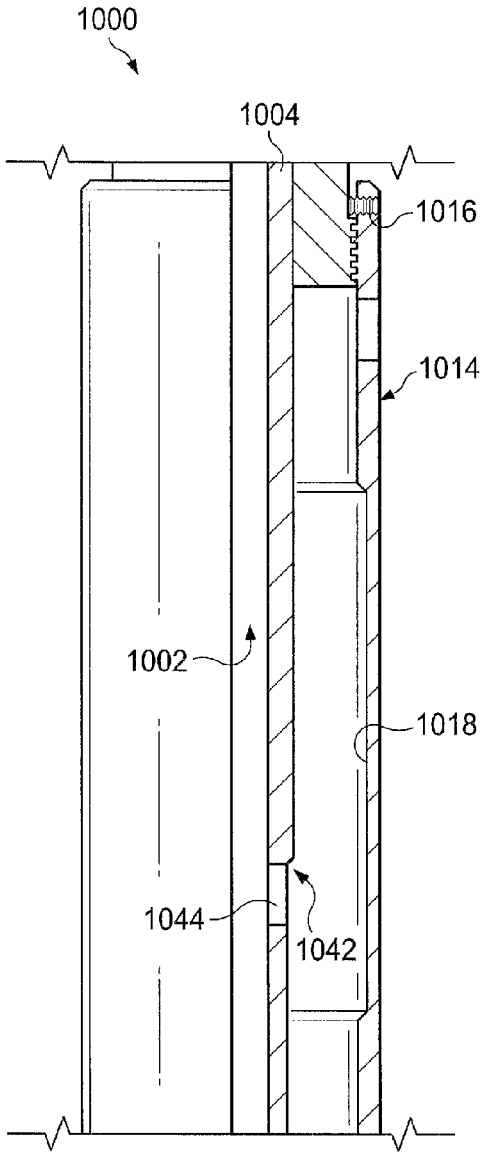
Figure 13D:
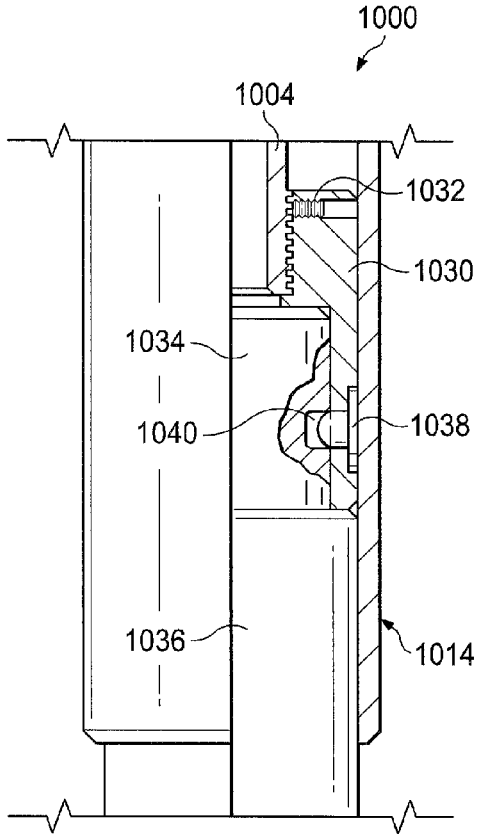

Turning next to FIG. 12, an alternative to the lower cup 940 for downhole tool 900 is shown as lower cup 960. The lower cup 960 is threaded onto the mandrel 904 of the downhole tool 900. However, the lower cup 960 can alternatively be attached using locking balls 944.

Lower cup 960 has a retractable elastomer lip portion 962 attached to a rigid cup base 964. The elastomer lip portion 962 can be substantially identical to elastomer lip portion 610, except that elastomer lip portion 962 extends downward instead of upward. Lower cup 960 also includes a lip sleeve 966. The lip sleeve 966 is attached to the retractable elastomer lip portion 962. The lip sleeve can be substantially identical to lip sleeve 607, but is urged upward by the elastomer lip portion 962 rather than downward as with the lip sleeve 607. The retractable elastomer lip portion 962 is retractable in that it is a resilient member urging to be retracted from the unset position shown in FIG. 12 to a set position substantially identical to the set position of elastomer lip portion 610 shown in FIGS. 11A and 11B (also shown in FIG. 8F), except that the set position of the elastomer lip portion 962 is inverted compared to the set position of elastomer lip portion 610.

The elastomer lip portion 962 and lip sleeve 966 are disposed around a mandrel 967 that is attached to, or an extension of, the cup base 964. The lower cup 960 includes soluble locking dogs 752, which are described above in connection with FIGS. 9A and 9B. The soluble locking dogs 752 are glued in place, as shown in FIG. 12, each extending through a respective locking dog slot 968 and into a respective recess 970 in the mandrel 967. The soluble locking dogs 752 dissolve in the well fluids after the downhole tool 900 with attached lower cup 960 is lowered into a well bore. Once the soluble locking dogs 752 are dissolved, the lip sleeve 966 is released allowing the retractable elastomer lip portion 962 to move to the set position described above.

The mandrel 967 defines a central opening 972 that extends longitudinally through the lower cup 960. A locking plug 974 blocks fluid communication between the central opening 972 of the lower cup 960. The locking plug 974 seals the inside of the downhole tool 900, which allows fluid flow along the outside of the downhole tool 900 while the downhole tool 900 is lowered in a well bore. The locking plug 974 is held in place by one or more soluble locking dogs 752, which are described above in connection with FIGS. 9A and 9B. Alternatively, other types of mechanisms can be used for removing the locking plug 974, for example using a pump-out plug or wireline retrievable plug.

While the cup 960 has been described as a "lower" cup 960 for the bottom of downhole tool 900, those skilled in the art will appreciate that the cup 960 can also be used as an upper cup for the upper end of a downhole tool, and that some embodiments of downhole tools can include a cup substantially identical to cup 960 on both upper and lower ends thereof.

Turning next to FIGS. 13A-13D, a downhole tool or frac plug embodiment is shown and generally designated as downhole tool 1000. The downhole tool 1000 has a central opening 1002 and a mandrel 1004, where the central opening extends longitudinally through the mandrel 1004.

The mandrel 1004 is attached to a setting tool 1100, which serves as an example of a setting apparatus. It will be clear to those skilled in the art that the setting tool 1100 is similar to setting tool 700, but the setting tool 1100 has a center mandrel 1104 that differs from the center mandrel 704 of the setting tool 700, as described below. Other components of the setting tool 1100 are substantially identical to components of the setting tool 700, and therefore have retained the same reference numbers.

Downhole tool 1000 defines a central opening 1002 therein. Downhole tool 1000 comprises a center mandrel 1004. The central opening 1002 extends longitudinally through the center mandrel 1004.

A retractable packer cup 1006 is disposed around an upper portion of mandrel 1004 and a lower portion of mandrel 1104. The packer cup 1006 generally encloses an o-ring 1008. The o-ring 1008 extends around the mandrel 1004 and can be made of any material suitable for serving as a seal to prevent the flow of fluid between the mandrel 1004 and the packer cup 1006.

The packer cup 1006 includes a collet 1007, a retractable elastomer lip portion 1010, and a rigid packer cup base 1012. The collet 1007 is attached, for example using an adhesive, to retractable elastomer lip portion 1010. The retractable elastomer lip portion 1010 is substantially identical to retractable elastomer lip portion 610, shown in FIGS. 8B and 8F. Thus, the retractable elastomer lip portion 1010 is retractable in that it is configured to retract from an unset position (identical to the unset position of elastomer lip portion 610 shown in FIG. 8B) to the set position shown in FIG. 13B.

The collet 1007 extends around the outer periphery of the mandrel 1104 of the setting tool 1100. The collet 1007 has a plurality of collet heads 1009 formed along an upper edge thereof. When the downhole tool 1000 is in an unset position, each collet head is retained at least partially within a respective collet slot 1011 formed in the outer surface of the mandrel 1104. The index sleeve 712 can include release slots 718, one for each collet head 1009, that release the collet heads 1009 from their respective collet slots 1011 when the index sleeve 712 is rotated (as described above in connection with FIGS. 8A-8F) to a position where the release slots 718 are aligned with respective collet heads 1009. Once the collet heads 1009 are released, the retractable packer cup 1006 urges the collet 1007 downward and the retractable packer cup 1006 expands to the position shown in FIG. 13B to contact the inner surface of the well bore.

A sleeve 1014 is attached to the lower end of the packer cup base 1012 and extends downward beyond the lower end of the mandrel 1004. The sleeve 1014 is threaded onto the outer surface of the packer cup base 1012 and held in place using a shear pin or set screw 1016. A recessed region 1018 is formed in the central portion of the inner surface of the sleeve 1014.

An adapter 1030 is disposed between the sleeve 1014 and the mandrel 1004. The adapter 1030 extends around the outer periphery of the mandrel 1004. The adapter 1030 is threaded onto the outer surface of the mandrel 1004 and held in place using a shear pin or set screw 1032. The adapter 1030 is used for attaching other tools to the lower end of the downhole tool 1000. The adapter 1030 is secured to the connecting portion 1034 of another downhole tool 1036. A plug 1038 extends through the adapter 1030 and at least partially into a hole or notch 1040 in the connecting portion 1034 of downhole tool 1036.

The plug 1038 can be released from the hole or notch 1040 in order to release the downhole tool 1036 from downhole tool 1000. First, the collet heads 1009 are released as described above. This allows the retractable packer cup 1006 to expand to the set position. Subsequent fluid weight or pump pressure can be then used to create differential pressure for pushing the packer cup 1006 downward relative to the mandrel 1004. As the packer cup 1006 travels downward, it exerts a downward force against the sleeve 1014, which is fixed to the packer cup base 1012. This causes the sleeve 1014 to travel downward with the packer cup 1006. As the sleeve 1014 travels downward, the recessed region 1018 of the sleeve 1014 will eventually align with the plug 1038. Note that the plug 1038 is not traveling with the sleeve 1014 and packer cup 1006 since the plug 1038 is fixed relative to the adapter 1030, which is attached and fixed relative to the mandrel 1004. Once the recessed region 1018 of the sleeve 1014 aligns with the plug 1038, the recessed region 1018 provides sufficient room for the plug 1038 to recede from the hole or notch 1040. The end of the plug 1038 that extends into the hole or notch 1040 is preferably rounded or tapered, so that when downhole tool 1000 pulls away from the downhole tool 1036 (while recessed region 1018 is aligned with plug 1038) the plug 1038 is pushed out of the hole or notch 1040 and at least partially into the recessed region 1018. This allows the connecting portion 1034 to be released from the adapter 1030, so the downhole tool 1038 can be separated from the downhole tool 1000.

Also, as the sleeve 1014 travels down the mandrel 1004, the o-ring 1008 will eventually align with a recessed region 1042 of the outer surface of the mandrel 1004. The recessed region 1042 can extend around the outer periphery of the mandrel 1004, thereby serving as a region of the mandrel 1004 having a relatively smaller outside diameter as compared with the outside diameter of the mandrel 1004 above the recessed region 1042. Since the o-ring 1008 is stretched around the outer surface of the mandrel 1004, the o-ring 1008 will be released upon encountering the smaller outside diameter of the recessed region 1042.

Also, a flow hole 1044 is provided in the recessed region of the mandrel 1004. The flow hole 1044 extends through the surface of the mandrel 1004, providing for fluid communication between outside the mandrel 1004 and the central opening 1002. The flow hole 1044 serves as a fluid bypass path so that the downhole tool 1000 can more easily be retrieved from a well without excess fluid resistance.

Figure 14A:
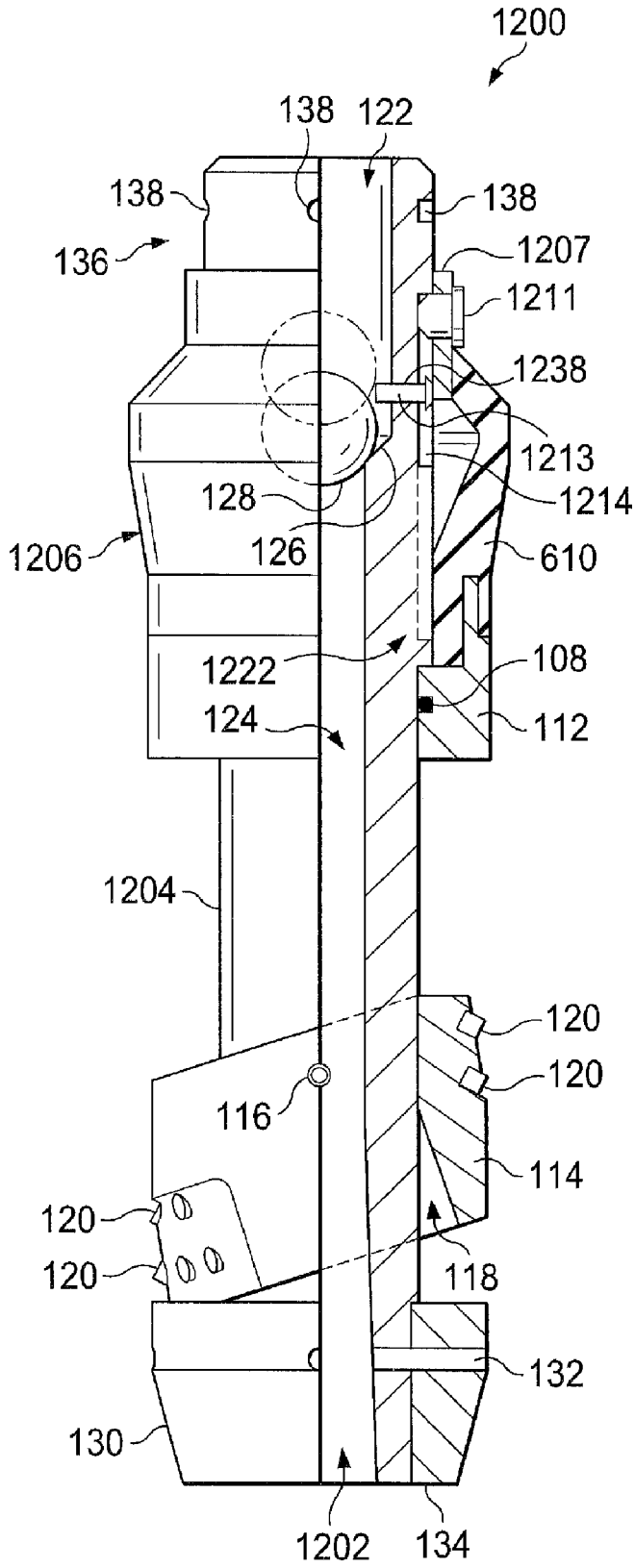
FIG. 14A shows a partly sectional view of an embodiment of a downhole tool that includes a mandrel having an index slot.
Figure 14B:
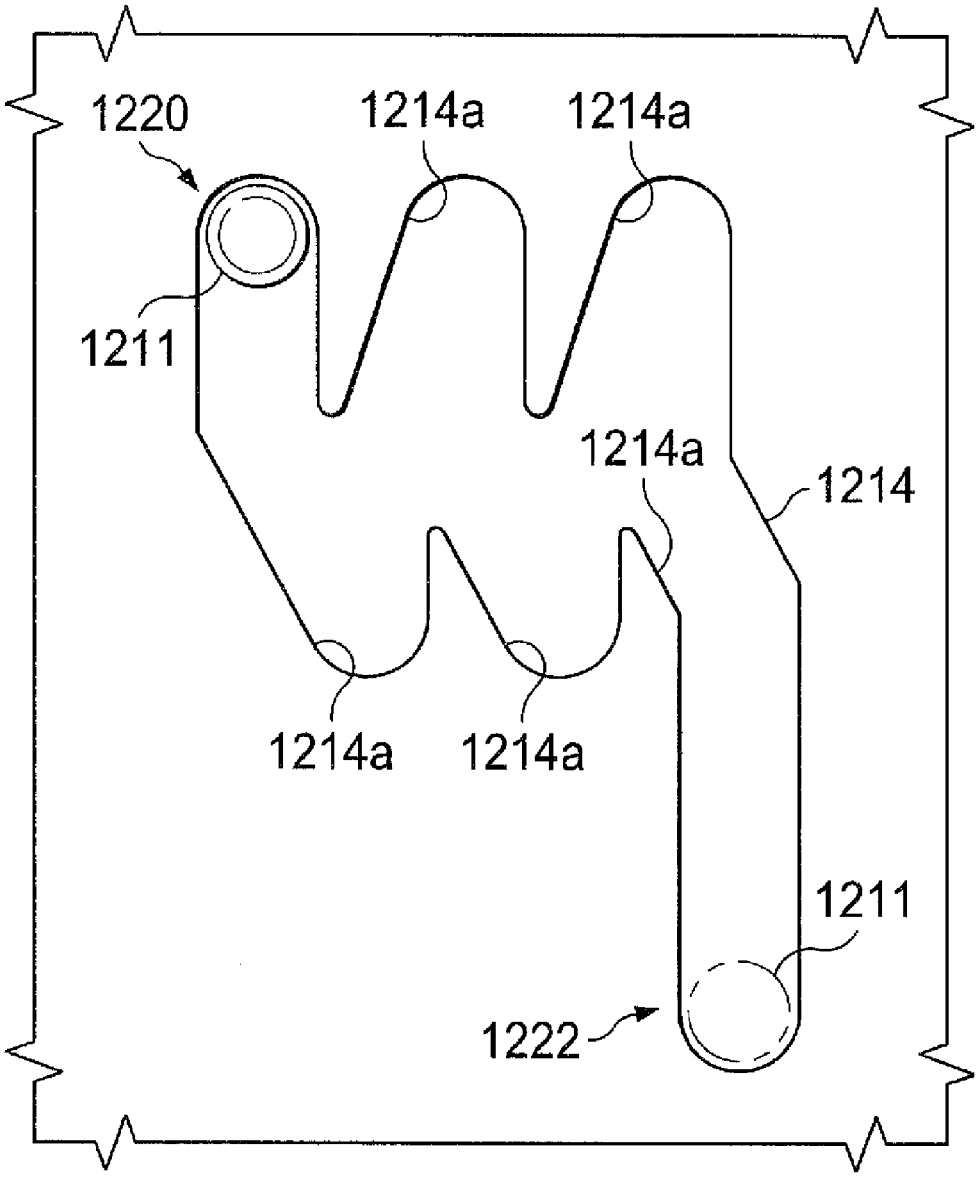
FIG. 14B shows a plan view of an index slot for the downhole tool shown in FIG. 14A.

Turning next to FIGS. 14A and 14B, a downhole tool embodiment is shown and generally designated as downhole tool 1200. It will be clear to those skilled in the art that the downhole tool 1200 is similar to downhole tools 100 and 600, but has a few significant differences.

Downhole tool 1200 defines a central opening 1202 therein. Downhole tool 1200 comprises a center mandrel 1204. The central opening 1202 extends longitudinally through the center mandrel 1204.

A retractable packer cup 1206 is disposed around mandrel 1204 and generally encloses an o-ring 108. The o-ring 108 extends around the mandrel 1204 and can be made of any material suitable for serving as a seal to prevent the flow of fluid between the mandrel 1204 and the packer cup 1206.

The packer cup 1206 includes a lip sleeve 1207, a retractable elastomer lip portion 610, and a rigid packer cup base 112. The lip sleeve 1207 is attached, for example using an adhesive, to retractable elastomer lip portion 610. The retractable elastomer lip portion 610 is substantially identical to retractable elastomer lip portion 610 shown in FIGS. 8B and 8F, and therefore retains the same reference number. Thus, the retractable elastomer lip portion 610 is retractable in that it is configured to retract from an unset position (identical to the unset position of elastomer lip portion 610 shown in FIG. 8B) to the set position shown in FIG. 14A. The rigid packer cup base 112 is substantially identical to rigid packer cup base 112 shown in FIGS. 8B and 8F, and therefore retains the same reference number. The lip sleeve 1207 is similar to the lip sleeve 607 shown in FIGS. 8B and 8F, but is configured for retaining one or more index pins 1211 rather than locking dogs 611. In some embodiments, the index pins 1211 are fixed to the lip sleeve 1207. In some embodiments, the lip sleeve 1207 is provided with integral extensions that serve as index pins 1211.

The lip sleeve 1207 extends around the outer periphery of the mandrel 1204 of the downhole tool 1200. The mandrel 1204 has at least one index slot 1214 formed in an outer surface thereof, but not necessarily extending completely therethrough. FIG. 14B shows a plan view of the index slot 1214. The index pin 1211 extends into the index slot 1214. In some embodiments, the mandrel 1204 can have two identical index slots 1214 formed in opposing sides of the mandrel 1204, and the lip sleeve 1207 has a respective index pin 1211 for each of the index slots 1214.

A plurality of ball pins 1213 extend radially through the wall of the mandrel 1204 and into the upper opening portion 122 of the mandrel 1204. The ball pins 1213 are distributed around the periphery of the mandrel 1204. The lip sleeve 1207 holds the ball pins 1213 in a fully inserted position such that the ball pins 1213 extend into the upper opening portion 122, where the ball pins 1213 keep the ball 128 in the position shown in broken lines where the ball 128 is retained above the ball seat shoulder 126.

The retractable packer cup 1206 is set such that the index pin 1211 is at or near the position 1220 (shown in FIG. 14B) in the index slot 1214 prior to lowering the downhole tool 1200 into a well bore. The lip sleeve 1207 covers the ball pins 1213 in this position, which prevents the ball pins 1213 from sliding radially outward. While the ball pins 1213 are locked in place by the lip sleeve 1207, the ball pins 1213 prevent the ball 128 from seating on shoulder 126.

The downhole tool 1200 is lowered into a well bore in this unset position. As with other embodiments disclosed herein, the downhole tool 1200 can be lowered using, for example, adapter 150 or release tool 200 as described above. As downhole tool 1200 is lowered, fluid can travel through the central opening 1202, around the ball 128, and out bypass holes in the setting adapter or release tool.

Once the downhole tool 1200 is lowered to the desired setting depth, the process of setting the downhole tool 1200 can begin. The mandrel 1204 is raised and lowered from above via a connecting line (not shown), such as a sand line, wire line, or other cable means, supporting the upper end of the mandrel 1204 at the connecting portion 136. As the mandrel 1204 is raised, fluid pressure in the well bore bears downward against the retractable packer cup 1206, causing the mandrel 1204 to move in an upward direction relative to the packer cup 1206, including the lip sleeve 1207. As the mandrel 1204 is raised relative to the lip sleeve 1207, the index pin 1211 begins to travel downward in the index slot 1214. Conversely, when the mandrel 1204 is subsequently lowered, the index pin 1211 travels in and upward direction in the index slot 1214.

The index slot 1214 includes a plurality of contact surfaces 1214*a* that extend at a non-zero angle relative to the upward and downward travel directions of the mandrel 1204. Each time the index pin 1211 is raised or lowered in the index slot 1214, the index pin 1211 urges against a subsequent contact surface 1214*a*. The angle of the contact surface 1214*a* is such that the lip sleeve 1207 is forced to rotate as the index pin 1211 is raised or lowered in the index slot 1214. In the embodiment shown in FIG. 14B, the index pin 1211 is shown in solid lines in the unset position and in broken lines in the set position. In this embodiment, the mandrel 1204 can be raised at least three times and lowered at least two times before the downhole tool 1200 will be set. In alternative embodiments, the index slot 1214 can include more or fewer contact surfaces, thus requiring more or fewer times that the setting tool 1200 can be raised and lowered before the downhole tool 1200 is set.

Once the setting tool 1200 has been raised and lowered the requisite number of times, the lip sleeve 1207 will be rotated to the point where the index pin 1211 can drop to the position 1222. This allows the packer cup 1206 to move downwardly, eventually bearing against the slip 114 causing the shear pin 116 to shear. From this point, the slip 114 will set in a manner that is substantially the same as described above in connection with FIG. 3. The shearing of the shear pin 116 allows the slip 114 to rotate from the position shown in FIG. 14A to a position that is substantially identical to the set position of the slip 114 that is shown in FIG. 3.

Also, the lowering of the packer cup 1206 causes the lip sleeve 1207 to move to a lower position relative to the mandrel 1204 that is below the ball pins 1213. Once the lip sleeve 1207 has dropped below the ball pins 1213, the ball pins 1213 are released and free to be pushed radially outward through pin holes 1238 in the mandrel 1204 under the weight and wedging action of the ball 128. Subsequent fluid weight or pump pressure will seat the ball 128 on the shoulder 126 of the mandrel 1204 in the ball 128 position that is shown in solid lines. The setting tool (not shown) can then be separated from the downhole tool 1200 by whatever means necessary depending on the type of setting tool that is being used, at which point the setting tool can be raised and removed from the well bore, leaving the downhole tool 1200 set in and sealing the well bore.

It will be apparent to those skilled in the art that an invention with significant advantages has been described and illustrated. Although the present application is shown in a limited number of forms, it is not limited to just these forms, but is amenable to various changes and modifications without departing from the spirit thereof.

What is claimed is:

1. A downhole apparatus for use in a well bore, the apparatus comprising:

a center mandrel;

slip means disposed on the center mandrel for grippingly engaging an inner surface of the well bore when in a set position;

a retractable packer cup disposed on the center mandrel for selectively sealing an annulus between the center mandrel and the well bore, the retractable packer cup being releasably coupled to the center mandrel, the retractable packer cup is slidable relative to the center mandrel when released so as to permit the expansion of an elastomeric lip portion to sealingly engage the well bore; and an o-ring that extends around the center mandrel for preventing the flow of fluid between the center mandrel and the retractable packer cup;

wherein the retractable packer cup seals the annulus prior to setting the slip means in the set position for engaging the well bore.

2. The apparatus of claim 1, wherein at least one of the center mandrel and slip means is at least partially made of a non-metallic material.

3. The apparatus of claim 1, further comprising:

an extrusion limiter at least partially disposed about the elastomeric lip portion of the retractable packer cup.

4. The apparatus of claim 1, further comprising a lip sleeve attached to the retractable elastomeric lip portion.

5. The apparatus of claim 4, further comprising at least one locking dog for securing the lip sleeve in place relative to the center mandrel.

6. The apparatus of claim 5, wherein the at least one locking dog includes at least one soluble locking dog.

7. The apparatus of claim 1, wherein the slip means comprises a generally cylindrical body having a dual-axis bore passage.

8. The apparatus of claim 1, wherein the slip means comprises a wedge slip assembly, the wedge slip assembly comprising at least one slip segment.

9. A downhole assembly for use in a well bore, said assembly comprising:

a downhole apparatus comprising:

a center mandrel;

a slip means disposed on the center mandrel for grippingly engaging an inner surface of the well bore when in a set position;

a retractable packer cup disposed on the mandrel for selectively sealing an annulus between the mandrel and the well bore, the retractable packer cup being releasably coupled to the center mandrel, the retractable packer cup is slidable relative to the center mandrel when released so as to permit the expansion of an elastomeric lip portion to sealingly engage the well bore; and an o-ring that extends around the center mandrel for preventing the flow of fluid between the center mandrel and the retractable packer cup;

wherein the retractable packer cup seals the annulus prior to setting the slip means in the set position for engaging the well bore;

a setting apparatus connected to the downhole apparatus for at least partially supporting the downhole apparatus while the downhole apparatus is lowered into the well bore.

10. The assembly of claim 9, the center mandrel comprising:

a connecting portion; and wherein the setting apparatus is connected to the connecting portion of the center mandrel.

11. The assembly of claim 10, wherein the setting apparatus is connected to the connecting portion via at least one shear pin.

12. The assembly of claim 11, wherein the setting apparatus includes an at least substantially sealed chamber filled with fluid having a predetermined pressure.

13. The assembly of claim 9, wherein:

the retractable packer cup comprises:

a lip sleeve attached to the retractable elastomeric lip portion;

the downhole apparatus further comprising:

at least one locking dog for securing the lip sleeve in place relative to the mandrel; and the setting apparatus comprises:

an index sleeve disposed around at least a portion of the mandrel;

an index slot formed in the index sleeve; and an index pin extending at least partially into the index slot.

14. The assembly of claim 13, wherein the index sleeve further comprises:

a locking dog release slot.

15. A method for setting a downhole tool in a wellbore, the method comprising:

lowering the downhole tool into the well, the downhole tool comprising a center mandrel, slip means disposed on the center mandrel, and a retractable packer cup disposed on the center mandrel in an unset position;

sealing an annulus between the mandrel and the well bore by selectively releasing the retractable packer cup from the center mandrel, the retractable packer cup having an elastomeric lip portion configured to urge radially outward in a relaxed set position, so as to contact and seal against the wellbore; and creating a differential pressure across the retractable packer cup sufficient for causing the set retractable packer cup to slide relative to the center mandrel towards the slip means such that the slip means moves to a set position, wherein the slip means is configured for grippingly engaging an inner surface of the well when in the set position; and wherein the retractable packer cup is configured to retract prior to being set in the set position.

16. The method of claim 15, further comprising:

supporting the downhole tool with a setting apparatus as the downhole tool is lowered into the well; and detaching the setting apparatus from the downhole tool after the slip means is moved to the set position, wherein the detaching of the setting apparatus includes applying a force to the setting apparatus suitable for shearing at least one shear pin.

17. The method of claim 15, further comprising:

supporting the downhole tool with a setting apparatus as the downhole tool is lowered into the well, wherein the setting apparatus includes an at least substantially sealed chamber filled with fluid having a predetermined chamber pressure; and detaching the setting apparatus from the downhole tool after the slip means is moved to the set position, wherein the detaching of the setting apparatus includes increasing a head pressure external to the setting tool at least until the head pressure exceeds the chamber pressure by a predetermined amount.

18. The method of claim 15, further comprising:

supporting the downhole tool with a setting apparatus as the downhole tool is lowered into the well, wherein the setting apparatus includes an index sleeve and the packer cup is a retractable packer cup;

after the downhole tool is lowered into the well, rotating the index sleeve until the retractable packer cup is free to retract; and detaching the setting apparatus from the downhole tool after the slip means is moved to the set position.

* * * * *